US010101121B2

(12) United States Patent
Cabrera et al.

(10) Patent No.: US 10,101,121 B2
(45) **Date of Patent: *Oct. 16, 2018**

(54) COLLAPSIBLE REFLECTIVE SIGHT FOR A FIREARM

(71) Applicant: Centre Firearms Co., Inc., Ridgewood, NY (US)

(72) Inventors: Juan D. Cabrera, Ridgewood, NY (US); Andrew Lees, San Antonio, TX (US); Richard Ryder Washburn, III, Ridgewood, NY (US); Richard Ryder Washburn, II, Ridgewood, NY (US)

(73) Assignee: CENTRE FIREARMS CO., INC., Ridgewood, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,589

(22) Filed: Aug. 28, 2017

(65) Prior Publication Data

US 2018/0017356 A1 Jan. 18, 2018

Related U.S. Application Data

(63) Continuation of application No. 15/293,634, filed on Oct. 14, 2016, now Pat. No. 9,823,044, which is a (Continued)

(51) Int. Cl.
*F41G 1/17* (2006.01)
*F41G 1/34* (2006.01)
(Continued)

(52) U.S. Cl.
CPC ..... *F41G 1/17* (2013.01); *F41G 1/10* (2013.01); *F41G 1/30* (2013.01); *F41G 1/345* (2013.01); *F41G 11/003* (2013.01)

(58) Field of Classification Search
CPC ... F41G 1/10; F41G 1/17; F41G 1/345; F41G 1/16; F41G 1/26; F41G 1/30; F41G 11/003; F41G 11/001; F41G 11/002
(Continued)

(56) References Cited

U.S. PATENT DOCUMENTS 1,602,116 A * 10/1926 Manahan ..... F41G 1/14 42/125
2,276,446 A * 3/1942 Zimmerman ..... F41G 1/033 42/140
(Continued)

OTHER PUBLICATIONS

Cabrera et al., "Collapsible Reflective Sight for a Firearm Including a Locking Mechanism", U.S. Appl. No. 15/293,634, filed Oct. 14, 2016.

*Primary Examiner* — John Cooper
(74) *Attorney, Agent, or Firm* — Keating & Bennett, LLP

(57) ABSTRACT

A collapsible reflective optical sight for a firearm includes a base configured to mount the optical sight to a firearm; a lens attached to and able to rotate with respect to the base, wherein the lens includes a first optic with a reflective surface, and the lens is movable between a collapsed configuration in which the lens is folded down with respect to the base for storage and a deployed configuration in which the lens is angled with respect to the base for use in aiming the firearm; a light source mounted to the base that reflects light off the reflective surface of the first optic to a user for aiming the firearm; and a hood rotatably mounted to the base and connected to an upper portion of the lens. Additionally, the collapsible reflective optical sight can include a firearm and a mechanical sight.

19 Claims, 24 Drawing Sheets

Related U.S. Application Data continuation-in-part of application No. 15/212,511, filed on Jul. 18, 2016, now Pat. No. 9,696,114.

(51) Int. Cl.
*F41G 11/00* (2006.01)
*F41G 1/10* (2006.01)
*F41G 1/30* (2006.01)

(58) Field of Classification Search
USPC ..... 42/111, 118, 124, 126, 127, 128, 138, 42/140, 147, 148, 113
See application file for complete search history.

(56) References Cited

U.S. PATENT DOCUMENTS 2,596,522 A * 5/1952 Bethke ..... F41G 1/30 42/113
5,577,326 A * 11/1996 Montelin ..... F41G 1/16 356/251
7,552,558 B1 * 6/2009 Ballard ..... F41G 1/01 356/255
7,921,591 B1 * 4/2011 Adcock ..... F41G 1/14 42/111
8,578,646 B2 * 11/2013 Joannes ..... F41G 1/48 42/113
9,046,320 B2 * 6/2015 Keng ..... F41G 11/003
9,068,801 B1 * 6/2015 Stecher, Jr. ..... F41G 11/00
9,212,867 B2 * 12/2015 Patterson ..... F41G 1/345
2009/0064979 A1 * 3/2009 Andrews ..... F41B 11/89 124/65
2012/0311912 A1 * 12/2012 Howe ..... F41G 1/01 42/111
2013/0036650 A1 * 2/2013 Larue ..... F41G 11/003 42/148
2014/0109456 A1 * 4/2014 Jung ..... F41G 1/30 42/113
2014/0150325 A1 * 6/2014 Keng ..... F41G 11/003 42/118
2015/0268000 A1 * 9/2015 Carroll ..... F41G 1/38 42/111
2016/0216069 A1 * 7/2016 Hancosky ..... F41G 1/345
2016/0223806 A1 * 8/2016 Mochinushi ..... G02B 23/105
2016/0266372 A1 * 9/2016 Baker ..... G02B 23/2446

* cited by examiner

COLLAPSIBLE REFLECTIVE SIGHT FOR A FIREARM

BACKGROUND

Field of the Disclosure

The present disclosure relates to a collapsible optical reflective gun sight, also referred to as a reflex or a red-dot sight, for a firearm that includes a locking mechanism used to mount the collapsible optical reflective gun sight to the firearm.

Discussion of the Related Art

Sighting systems can be mounted on small arms to assist the user in aiming and firing a projectile towards a target. Small arms may include a machine gun, rifle, shotgun, handgun, pistol, paint-ball gun, air gun, bow, cross-bow, and the like. The term firearm is used throughout this disclosure to denote any gun or small arm, including but not limited to those just described, that can benefit from the inclusion of the disclosed sight system used to increase shooting accuracy.

Well known, mechanical or iron sights typically include two components mounted and fixed at different locations on the firearm which are visually aligned with the line of sight of the user and the target. FIGS. 1A and 1B show a folding optical sight from U.S. Pat. No. 5,533,292 in the related art. As disclosed in U.S. Pat. No. 5,533,292, FIG. 1A shows the flip-up rear mechanical sight folded down or closed and FIG. 1B shows the flip-up mechanical sight up and open, ready to be used in aiming the firearm.

As shown in FIGS. 1A and 1B, mechanical sights can be large, cumbersome to use, and include many moving parts. Thus, mechanical sighting systems can become misaligned from rough handling, impact, use, wear in the various components, or environmental effects. At longer distances, precise aiming at a target down range can take time.

To overcome problems with mechanical sights, optical sights or scopes are employed. Optical sights typically use optics to superimpose a pattern, reticle, or aiming point to assist in targeting. Many optical sights using reticles are telescopic for improved viewing and aiming precision at longer ranges. Typically, the time to acquire a target can be reduced using an optical sight, and accuracy can be improved.

In other optical sights, a laser pointer or external light-dot sight typically uses a laser diode to emit a beam parallel to the barrel of the firearm and illuminate a spot on the target. An external dot sight uses a laser pointer to project a laser beam directly onto the target leaving the illuminated "dot" on the target for acquisition. In this sight system, the illuminated dot can easily be seen. However, if the ambient light intensity is high or the target is farther away or not reflective, the user may have a hard time seeing or be unable to locate or identify the dot on the target as the ambient light may wash out the target dot. Increasing the intensity of the light source providing the dot in an attempt to overcome this washing out more quickly decreases the useful life of the battery used to power the light source.

Internal reflective sights overcome these problems. A reflective sight type is generally non-magnifying and allows the user to look though a glass element at the target and see a reflection of an illuminated aiming point superimposed on the target within the field of view. An internal reflective sight only uses a dot within the sight system where the dot is not projected onto the target, but only reflected back to the user.

At the target, the internal dot is not visible and is not effected by ambient light. This allows for more covert use as those down range do not know a target is being acquired, and the projected dot does not give away a user's direction or location.

A typical configuration of a reflective optical sight of the related art is shown in FIG. 2A, as disclosed in U.S. Pat. No. 6,327,806. FIG. 2B shows a side view of the reflective sight of FIG. 2A mounted on a handgun, as disclosed in U.S. Pat. No. 6,327,806.

As shown in FIG. 2B, the related art optical sight protrudes above the top of the slide of the semi-automatic handgun. This increase in profile causes the firearm to become more cumbersome.

For example, the sight adds weight to the firearm. The location of the center of gravity of the related art sight can change the gun mechanics. Specifically, the related art sight can change the slide action and recoil of a handgun, thus increasing the possibility of jamming, premature wear, or other malfunction.

The bulky protrusion of the related art sight outside the original outline profile of the gun makes the handgun on which it is mounted harder to holster. An original holster may need modification or a new specially designed holster may be required to adequately accommodate the related art sight. Further, the related art sight may cause difficulty in drawing the handgun from the holster as it will be easier to catch the sight on an article of clothing, body armor, or other piece of gear.

The bulky protrusion of the related art sight also causes a firearm in which it is mounted to be less covert. The related art sight causes an irregular point outside of the firearm profile that sticks out and is more obvious as a threat. This would be undesirable in a concealed carry situation when the protrusion causes an unnatural and peculiar shaped bulge in the user's clothing that would be more noticeable.

The protrusion of the sight may also cause discomfort by digging into the body during certain body movements of someone wearing a handgun in either an open holstered or concealed carry situation.

Also, as shown in FIG. 2B, the reflective sight replaces a conventional mechanical sight used with a handgun. If the light source battery dies or the light system fails, the sight is rendered useless, and there is no backup sighting system on a handgun.

Non-Patent Literature of Hera (www.thefirearmsblog.com/blog/2010/04/26/hera-arms-cqs-foldable-reflex-sight) ("Hera product") shows a flip-up reflective or "red dot" sight used with a rifle disclosed in a firearms blog dated 2010. One image of the Hera product shows the flip-up reflective sight in a closed position, and another image shows the flip-up reflective sight in an open position. The Hera product has a spring-loaded lens or optic that is retractable and includes a latch that releases the lens from the closed configuration into the open configuration.

As shown, the Hera product is mounted on a rail of a rifle and is low profile with respect to other related-art reflex sights. However, when deployed, the lens is susceptible to being broken or damaged by impact or abrasion. The lens is not protected at all in the open or closed configurations. Also, there is no disclosure of the Hera product being used with or mounted on a handgun.

SUMMARY

In view of the problems described above, preferred embodiments of the present invention provide collapsible reflective sights for a firearm and provide rugged collapsible reflective sights that are less susceptible to damage from shock, impact, or external physical contact than that of the related art.

Another advantage of a preferred embodiment of the present invention is to provide a collapsible reflective sight that is low profile in the closed configuration so that it is less susceptible to damage when stored and easier to conceal and harder to detect.

Another advantage of a preferred embodiment of the present invention is to provide a collapsible reflective sight that can weigh the same as material eliminated from the slide of a semiautomatic firearm.

Another advantage of a preferred embodiment of the present invention is to provide a collapsible reflective sight that stays within the dynamics of a semiautomatic firearm and does not adversely affect movement of the slide, recoil, round feeding, or case ejection.

Another advantage of a preferred embodiment of the present invention is to provide a collapsible reflective sight where pressure can be used against it to move or rack a slide from a semiautomatic firearm to cock the gun, feed a round, or fix a jam, etc. without affecting the sight.

Another advantage of a preferred embodiment of the present invention is to provide a collapsible reflective sight that is easily deployable from the collapsed or stored configuration.

Another advantage of a preferred embodiment of the present invention is to provide a collapsible reflective sight that includes a mechanical sight component for use as a back-up sight or in situations where it is undesirable to deploy the reflective sight.

Another advantage of a preferred embodiment of the present invention is to provide a collapsible reflective sight that is modular and serviceable in the field rather than at a gunsmith, depot, or armory.

Another advantage of a preferred embodiment of the present invention is to provide a collapsible reflective sight where the boresight remains unchanged after changing or servicing the light source battery.

Another advantage of a preferred embodiment of the present invention is to provide a collapsible reflective sight capable of optical enhancement where the light source is easily filtered, made secure by reducing its infrared signature, or made night-vision compatible.

Another advantage of a preferred embodiment of the present invention is to provide a collapsible reflective sight that includes a self-contained locking mechanism used to mount and unmount the collapsible reflective sight to the firearm without separate fasteners or hand tools.

According to a preferred embodiment of the present invention, a collapsible reflective optical sight for a firearm includes a base that mounts the sight to the firearm; a lens attached to and able to rotate with respect to the base, wherein the lens includes a first optic with a reflective surface and the lens is folded with respect to the base for storage in a collapsed configuration and is angled with respect to the base in a deployed configuration for use in aiming the firearm; a light source on the base that reflects light off the reflective surface of the first optic to a user for use in aiming the firearm; a mechanical sight on the base for use in aiming the firearm when the lens is in the collapsed configuration; and a locking mechanism to mount the collapsible reflective optical sight to the firearm.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

It is to be understood that both the foregoing general description and the following detailed description are exemplary. The descriptions herein are not intended to limit the scope of the present invention.

Collapsible optical reflective sights, in accordance with exemplary preferred embodiments as disclosed herein, are mountable to a firearm and capable of being activated between a collapsed configuration and a deployed configuration. In the collapsed configuration, which is also referred to as a closed or stored configuration, the sight components are folded together into a low profile where the components are protected, and the optical sight is not usable. However, in the collapsed configuration, an integral mechanical sight is usable. In the deployed configuration, which is also referred to as an open configuration, the components of the optical reflective sight are oriented to be operational and capable of targeting as intended with the reflected dot.

First Preferred Embodiment

Figure 1A:
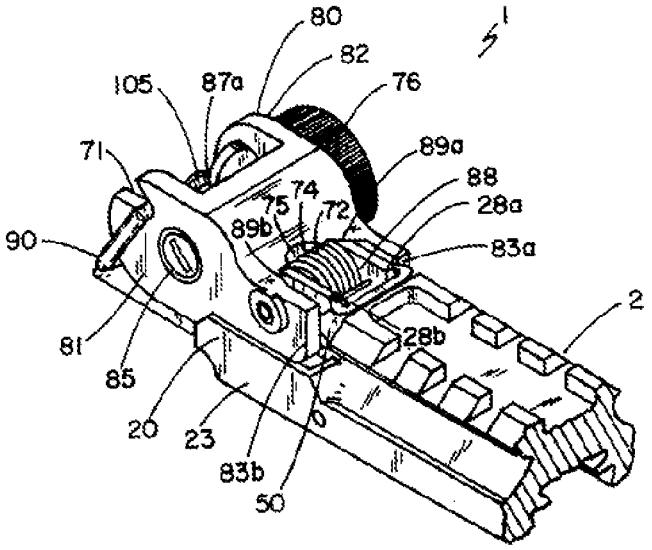
FIG. 1A Related Art
FIGS. 1A and 1B are views of a folding sight according to the related art.
Figure 1B:
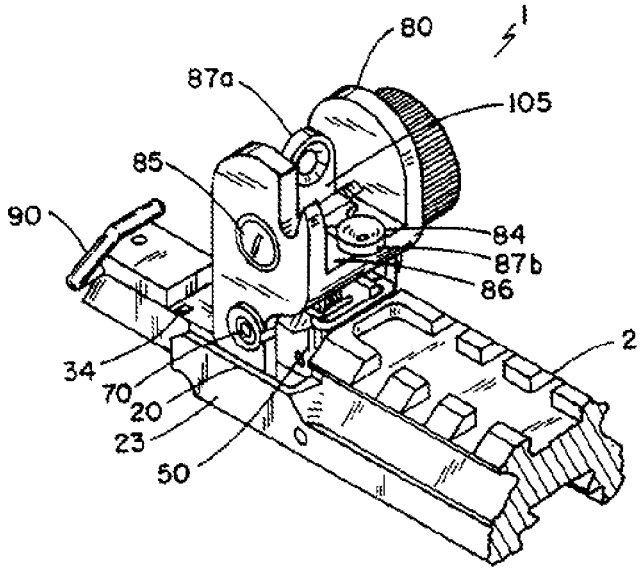
FIG. 1B Related Art
Figure 2A:
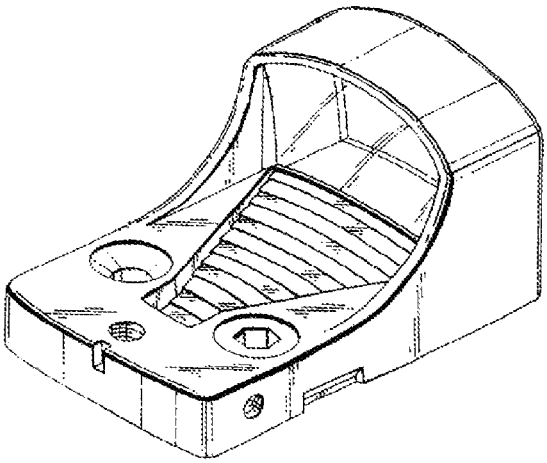
FIG. 2A Related Art
FIG. 2A is a view of a reflective sight according to the related art.
Figure 2B:
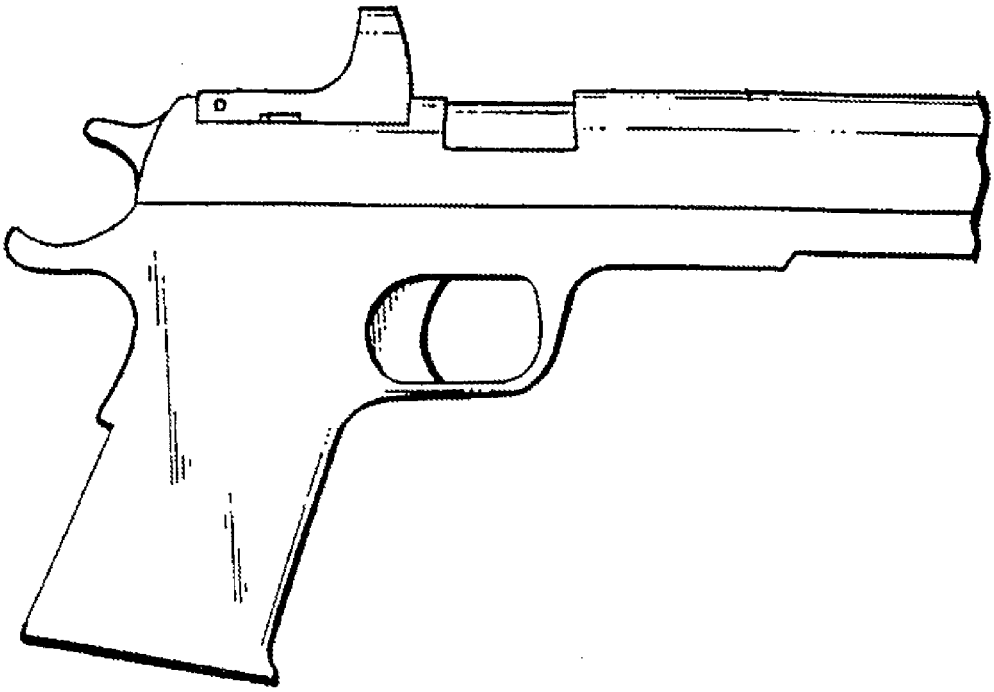
FIG. 2B Related Art
FIG. 2B is a side view of the related art reflective gun sight of FIG. 2A shown mounted on a handgun.
Figure 3A:
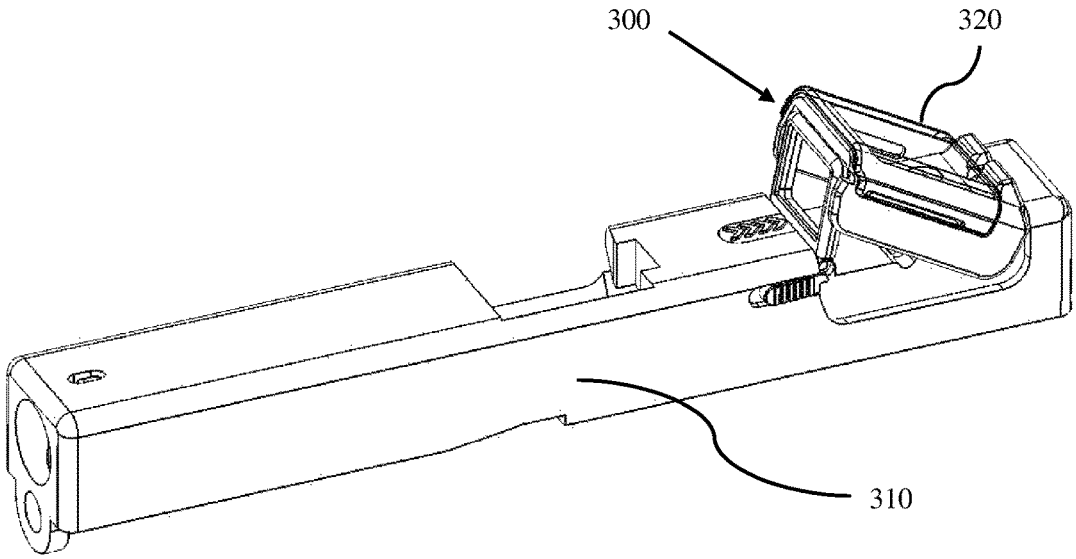
FIG. 3A is an illustration of a perspective view of a collapsible reflective sight for a firearm in a deployed configuration according to a first exemplary preferred embodiment of the present invention.
Figure 3B:
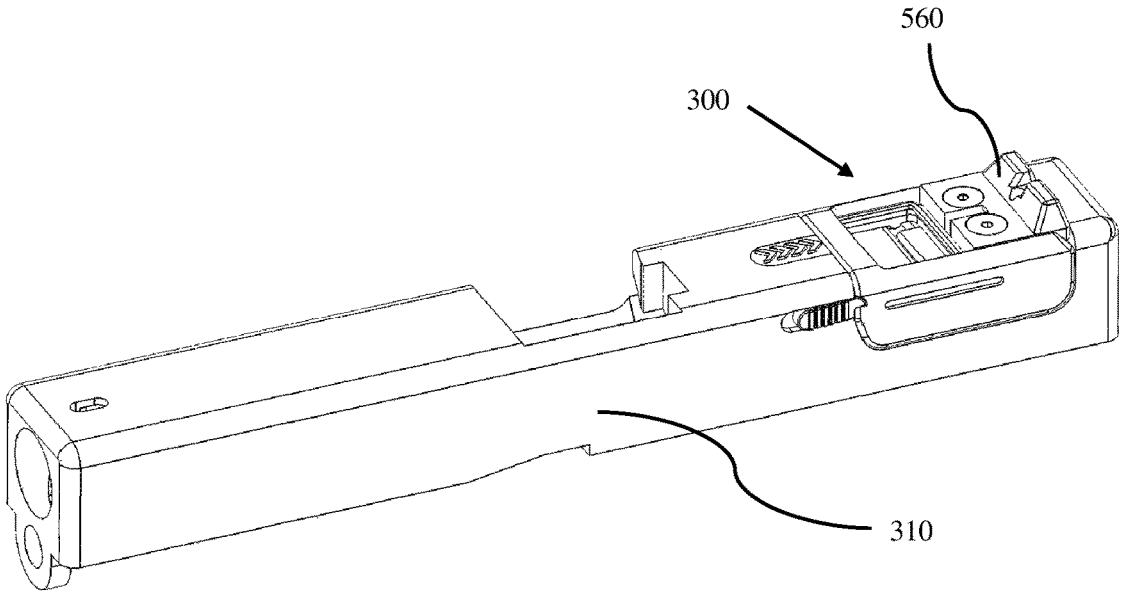
FIG. 3B is an illustration of a perspective view of an exemplary collapsible reflective sight for a firearm in a collapsed configuration according to the first exemplary preferred embodiment of the present invention.

FIGS. 3A and 3B illustrate a perspective view of the collapsible optical reflective sight 300 (hereinafter may be referred to as "optical reflective sight") mounted on a firearm slide 310, in accordance with a first exemplary preferred embodiment. FIG. 3A illustrates the collapsible optical reflective sight 300 in the deployed configuration in a usable position. Also, illustrated is an optional protective external cover 320. FIG. 3B illustrates the collapsible optical reflective sight 300 mounted on the firearm slide 310 in the collapsed configuration shown with the external cover 320 removed. The optical reflective sight 300 cannot be used in the collapsed configuration, but the mechanical sight is available for targeting, as will be discussed below.

As illustrated in FIG. 3B, in the collapsed configuration, the optical reflective sight 300 is low profile, fits within the original outline profile of the hand-gun slide 310, and includes a rear component of a mechanical or iron sight 560.

Figure 4:
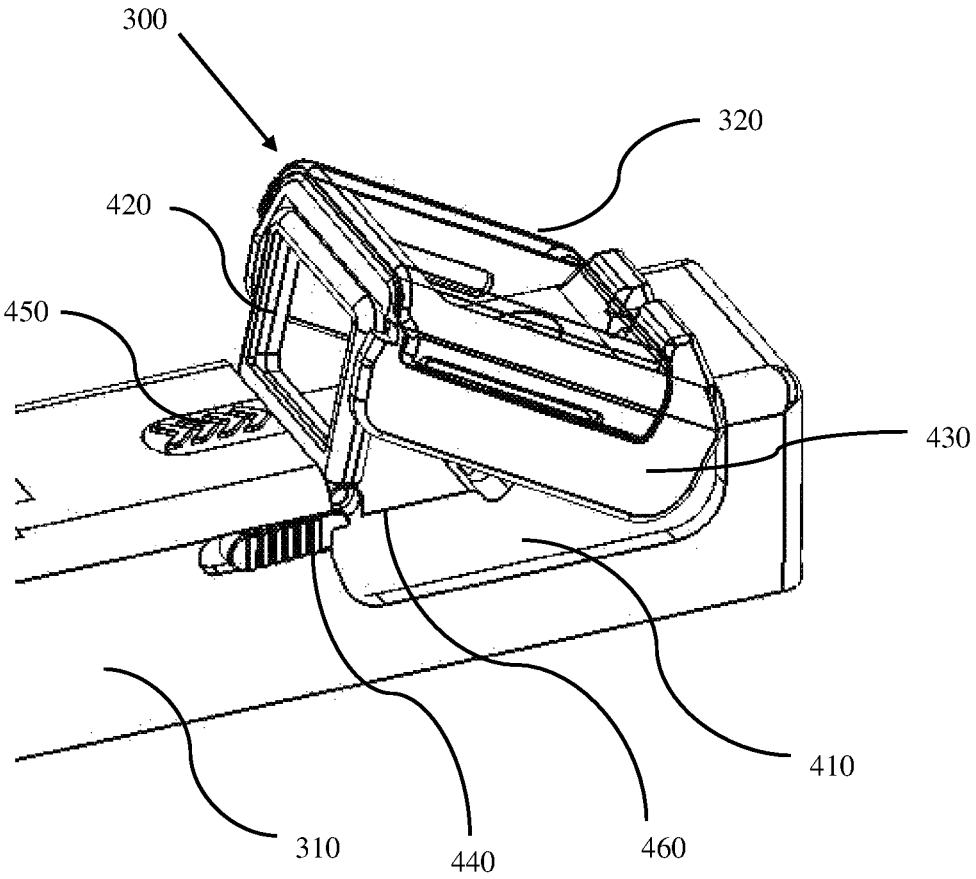
FIG. 4 is a close-up view of an illustration of an exemplary collapsible reflective sight for a firearm in a deployed configuration according to the first exemplary preferred embodiment of the present invention.

FIG. 4 is a close-up perspective view of the reflective sight 300 in the deployed configuration mounted on the firearm slide 310 as illustrated in FIG. 3A. As illustrated, the reflective sight 300 includes a base 410, a lens 420, a hood 430, a locking switch 440, a battery compartment 450, and a spring 460. As described in more detail below, a light source is integrated into the rear portion of the base and illuminates a reflective surface of the lens, which reflects a targeting point or "dot" back to a user, as is known in the art of reflective sights.

Figure 5:
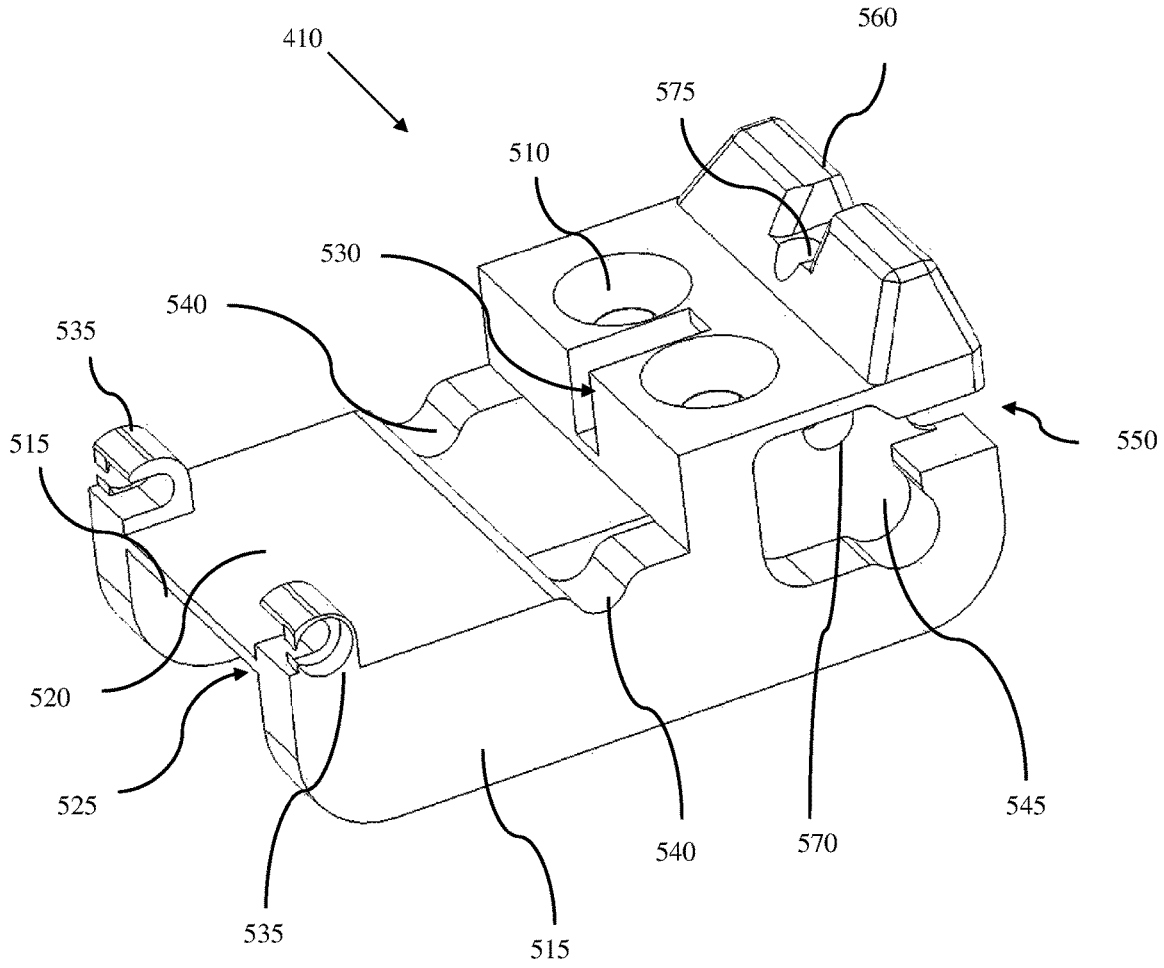
FIG. 5 is an illustration of a base of the collapsible reflective sight according to the first exemplary preferred embodiment of the present invention.

FIG. 5 is a perspective view of the base 410. As illustrated in FIGS. 3A, 3B, and 4, the base 410 fits into a cutout in the firearm slide 310, but may alternatively be mounted on a rail of a rifle or other firearm. As such, the base 410 includes mounting features to allow the base to secure the base 410 to the firearm. The mechanical interface features may vary based on the individual firearm and mounting location and may include, but is not limited to, bosses, recesses, slots, steps, flanges, dove tails, and the like. Further, the base 410 may be mounted to a firearm via a separate interface or adapter plate, as further described below.

As illustrated in FIG. 5, the base 410 is secured to the firearm with screws into threaded recesses in the slide 310 through screw holes 510. The screw holes 510 may be on the top, side, or any other portion of the base 410 suitable to secure the base 410 to the firearm. Alternatively, the base 410 can be tapped or include threaded features to accept screws through screw holes in a firearm component or adapter feature.

The base 410 also includes features that retain and support other components of the collapsible reflective sight as will be detailed further below.

As further illustrated in FIG. 5, the base 410 may include a body with two sides 515 with inner and outer surfaces and a cross member 520 defining a channel 525 between the two sides 515. The sides 515 fit into a recessed cutout in the slide 310, and each side includes geometric features to mate with complementary features on the firearm.

The base 410 also includes an opening or slot 530 to allow light emitted from a light source, such as a light emitting device (e.g., diode or laser), to illuminate a reflective surface of the lens. The light source may be mounted in a recess in the bottom of the base 410, and this recess is preferably sealed to protect the light source. The light source power and/or control wiring may be routed through the channel 525 from a battery compartment 450 located forward of the base.

The slot 530 may be configured to mount and retain a lens, protective window, optical filter, light pipe, and the like, or a combination thereof (not shown). A lens may be desirable to focus or otherwise alter the path of emitted light. A clear window may be desirable for protection of the light source slot 530. A filter may be desirable to change the color of the emitted light, reduce the infra-red signature, or enable compatibility with a night-vision imaging system (NVIS) (e.g., night-vision goggles) worn by a user. A light pipe may channel light from the light source to lens.

The base 410 further includes structural features to mount and retain the lens 420. As illustrated in FIG. 5, the lens mounting features can include two lens mounting slots 535 that are at the top of the two sides 515. The lens mounting slots 535 can receive rounded bosses in the lens 420 or a pin that may be inserted into the mounting slots 535 to define a hinge or pivot arrangement to allow the lens 420 to rotate with respect to the base 410.

The base 410 may further include notches 540 to accept tracking tabs from the lens 420, as will be described further below, to allow the lens 420 to lie flat when the collapsible optical reflective sight 300 is in the collapsed configuration.

The base 410 further includes features to mount and retain the hood 430. As illustrated in FIG. 5, the hood mounting features may include two recesses 545 that are on each of the two sides 515. The recesses 545 may receive rounded spring bosses in the hood 430 that may be inserted into recesses 545 via hood mounting slots 550 to define a hinge or pivot arrangement to allow the hood 430 to rotate with respect to the base 410.

Figure 16:
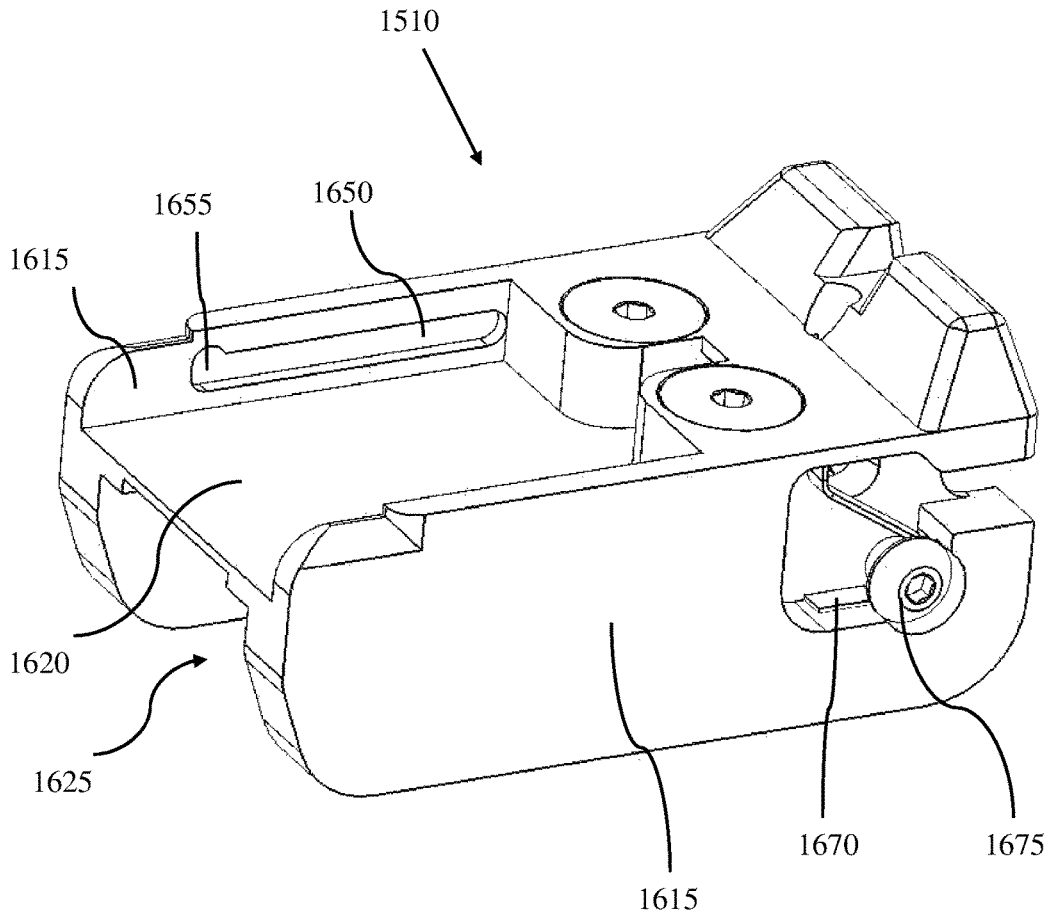
FIG. 16 is an illustration of a base of the collapsible reflective sight according to the third exemplary preferred embodiment of the present invention.

A spring (not shown) may be located in each of the recesses 545 on both sides 515 of the base 410 and oriented to provide rotational torque to the hood 430 (e.g., see FIG. 16). The springs can be a leaf spring, a coil, or any other suitable spring type. The springs may be retained in the recesses 545 by a fastener coupling the spring to the base 410 or can be retained in a groove within the recesses 545. One end of the spring under tension is stabilized by the base 410, and another end of the spring is forced against a portion of the hood 430 for spring-assisted deployment when the spring tension is released.

The reflective optical sight 300 can further include features for a mechanical or iron sight. As illustrated in the drawings, the mechanical sight 560 can be located on the base 410, but can also be located on the hood 430 or the lens 420. The mechanical sight 560 is useable when the collapsible optical reflective sight 300 is in the collapsed configuration, as illustrated in FIG. 3B. The mechanical sight 560 can be used as a secondary sight in situations when it is undesirable to deploy the collapsible reflective sight 300. The mechanical sight 560 can also be used if the collapsible optical reflective sight 300 is damaged or otherwise failed, such as by battery depletion or light source failure.

As known in the art, the rear mechanical sight 560 can be used with a second sight component located elsewhere more forward on the firearm to assist in aiming the firearm. The mechanical sight 560 can be a notch or groove as illustrated, but can also be a post, blade, bead, ring, or other suitable configuration. The mechanical sight 560 can be fixed or adjustable with respect to the base 410. Boresight adjustment of the mechanical sight can be made by screws or movement by force with the mechanical sight mount. The mechanical sight 560 can include night-sight aids such as illumination, tritium, fluorescence, or other glow-in-the-dark material for use in darker ambient conditions.

Boresight adjustments can be performed by adjusting screws to orient the collapsible optical reflective sight 300 with respect to the firearm. For example, as illustrated, boresight adjustment screws may be accessed via screw holes 570, 575 in the base 410. A screws in hole 570 can adjust in azimuth directions, and a screw in hole 575 can adjust in the elevation directions.

The base 410 can be fabricated from metal, ceramic, composite, plastic, or any other material suitable for the purpose of mounting the collapsible reflective sight 300 and retaining the other components, as further described below.

Figure 6:
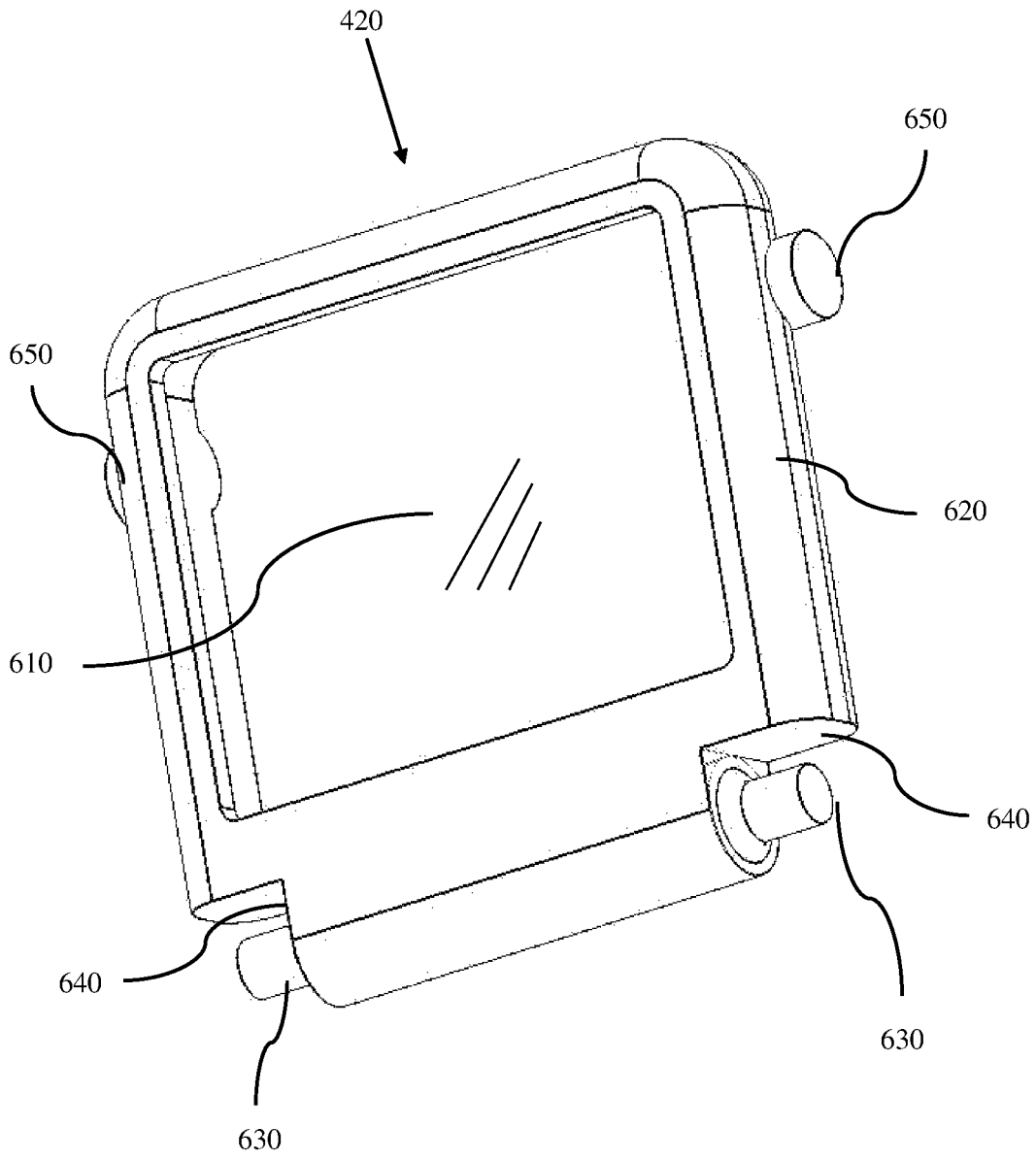
FIG. 6 is an illustration of a lens of the collapsible reflective sight according to a first exemplary preferred embodiment of the present invention.

FIG. 6 is a perspective view of the lens 420. As illustrated in FIG. 6, the lens 420 includes a lens, window, or optic 610 and a frame 620 that holds and protects the window 610.

As mentioned above, the window 610 includes a reflective surface in which the light source illuminates and reflects the illuminated light (dot) back to the user. As known in the art, the user then aligns the firearm to superimpose the reflected dot on the target to acquire the target.

As illustrated in FIG. 6, the window 610 may preferably be rectangular or substantially rectangular; however, the window 610 can be any suitable shape including round, oval, multi-facetted, or polygon.

The window 610 can be made from any suitable optical material including acrylic, polycarbonate, glass, sapphire, and the like. Preferably, the window 610 is clear and moisture, shock, and scratch resistant. Optionally, the window 610 can be colored.

Besides including a reflective surface, the window 610 can include any suitable coating on either or both the front and rear surfaces to aid in improving optical performance and environmental integrity. Coatings can include hard coating, tinting, anti-scratch, anti-reflection, hydrophobic, hydrophilic, and the like. The window 610 can also include a reticle, cross-hair, scale, or any other targeting aid.

The window 610 can be any size and thickness that is suitable for the corresponding firearm and that allows the collapsible optical reflective sight to be collapsible. Further, the window 610 can include convex or concave aspherical optical elements to enhance optical performance. The window 610 can add power, can add focus for the light source dot or reflection to the user, can minimize aberrations, and the like. Preferably, the widow 610 should provide adequate field of view and minimize parallax between the user's line of sight and the target.

As illustrated in FIG. 6, the window 610 is mounted in the frame 620. Therefore, the frame 620 includes geometric features to allow the frame 620 to mount and retain the window 610. Preferably, the window 610 is press fit or adhered to the frame 620. The frame 620 thickness can be thinner, the same as, or thicker than the window 610.

The frame 620 can be configured to enclose the window 610 along all lateral sides. Alternately, the frame 620 can contact and retain the window 610 on less than all sides such that the frame is U-shaped or I-shaped making contact on less that all sides of the window 610. Alternately, the frame 620 can be more than one piece or be opened to retain the window 610 in a clam shell or sandwich type arrangement.

The frame 620 can be fabricated from metal, ceramic, composite, plastic, elastomeric, or any other material suitable to retain the window 610, mounting to the base 410, and performing the other functions described below.

As further illustrated in FIG. 6, the frame 620 includes pivot tabs 630. The pivot tabs 630 can be located at a lower portion of the frame 620 and can mate with the lens mounting slots 535 of the base 410 described above. The pivot tabs 630 are preferably rounded so that they allow the lens 420 to rotate within the mounting slots 535, thus, allowing the lens 420 to rotate with respect to the base 410. Optionally, the pivot tabs 630 can be at the top portion of the frame 620.

The pivot tabs 630 can be integrally formed as part of the frame 620. Alternatively, the pivot tabs 630 can be mounted to the frame 620. Alternatively, the pivot tabs 630 can be two ends of a pin that is inserted through a hole in the lower portion of the frame 620. Alternatively, the pivot tabs 630 can be ends of two pins that are each inserted in a hole in the lower portion of the frame 620.

The lower portion of the frame 620 can also include spring retaining features. As illustrated in FIG. 6, spring retaining features include surfaces 640. The surfaces 640 can contact with an end of spring 460 shown in FIG. 4. The other end of the spring can contact a surface of the slide 310, the base 410, or the battery compartment 450. There can be a plurality of springs 460 with a number mounted on either or both sides of the frame 620.

The spring 460 can be oriented such that it is in a higher compressed state when the lens 420 is lying flat in the base 410 in the collapsed configuration than when the lens 420 is rotated at an angle with respect the base 410 in the deployed configuration. The compressed spring 460 assists to force rotation of the lens 420 into the deployed position, as shown in FIGS. 3A and 4, once the locking switch 440 is released allowing the spring 460 to decompress.

A coil of the spring 460 can be around the pivot tabs 630. Alternatively, the spring 460 may be coiled around the shaft of a pin at the lower portion of the frame 620 or multiple springs may be around the shaft of multiple pins.

Optionally, there can be a single spring located in a grove between the pivot tabs. The spring can be a leaf, coil, or any suitable type.

As illustrated in FIG. 6, the frame 620 further includes tracking tabs 650. The tracking tabs 650 are features that travel within a track located in the hood 430, as will be further described below.

The tracking tabs 640 can be integrally formed as part of the frame 620. Alternatively, the tracking tabs 650 can be mounted to the frame 620. Alternatively, the tracking tabs 650 can be two ends of a pin that is inserted through a hole in an upper portion of the frame 620. Alternatively, the tracking tabs 650 can be ends of two pins that are each inserted in a hole in the upper portion of the frame 620.

When in the collapsed configuration, the tracking tabs 650 can lie within the notches 540 of the base 410 to allow lens 420 to fold under the hood 430 and lie flat.

Alternatively, the frame 620 can be omitted from the collapsible gun sight. In this case, the window 610 can be integrated with the mechanical mounting and rotating features of the lens 420 with respect to the base 410 and hood 430, as described above.

Figure 7:
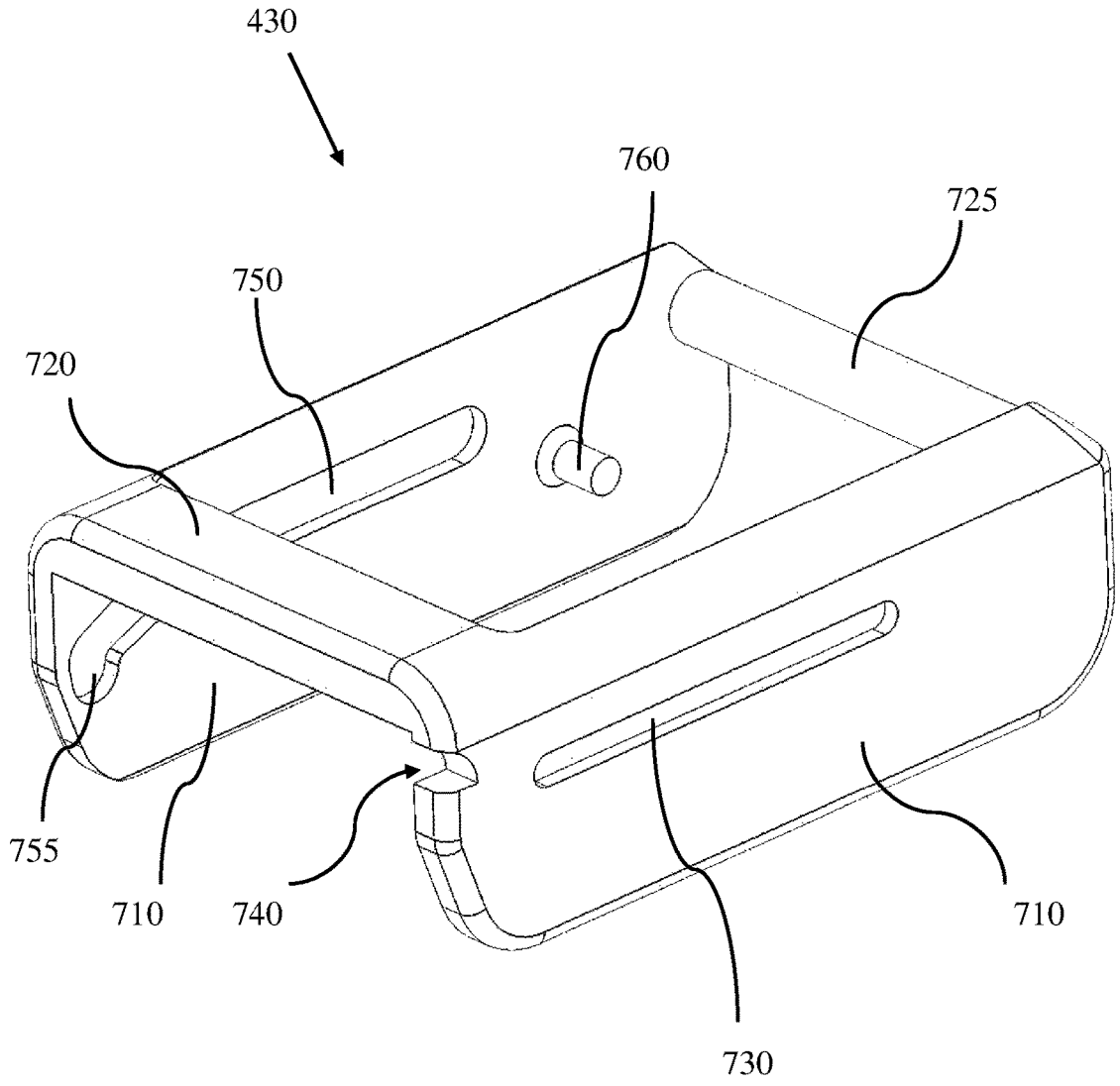
FIG. 7 is an illustration of a hood of the collapsible reflective sight according to the first exemplary preferred embodiment of the present invention.

A perspective view of the hood 430 is illustrated in FIG. 7. As illustrated, the hood 430 has generally an inverted U-shape with two corresponding opposite sides 710 defining the sides of the U-shape, and a cross member 720 and a mounting bar 725 connecting the sides 710 and defining the base of the U-shape.

The hood 430 can be fabricated from metal, ceramic, composite, plastic, or any other material suitable for the purpose of protecting the lens, light source, and other components when the gun sight is in the collapsed configuration. The hood 430 provides structural support when the gun sight is deployed, as will be further described below.

As illustrated in FIG. 7, two sides 710 are oriented opposite and parallel with each other. The sides 710 are shaped to slide over corresponding sides of the base 410 when in the collapsed configuration as illustrated in FIG. 3B. Also, as shown, the sides 710 fit into the cut-away portion of the slide 310. The outer surfaces of the sides 710 can be flush with the outer surfaces of the slide 310.

A recess 730 can be included in the outer surface of one or both of the sides 710. The recess 730 can accept tabs on the external cover 320 to attach the cover 320 and retain it to the hood 430. In this case, the external cover 320 can be aligned by a user and pushed into place such that tabs on the cover 320 snap into the recesses 730.

The recess 730 can also provide a texture to aid in gripping the hood 430 if a user needs to lift the hood 430 to deploy the optical reflective sight in a situation where the springs are weak, broken, fouled, or component movement is somehow restricted.

Figure 18:
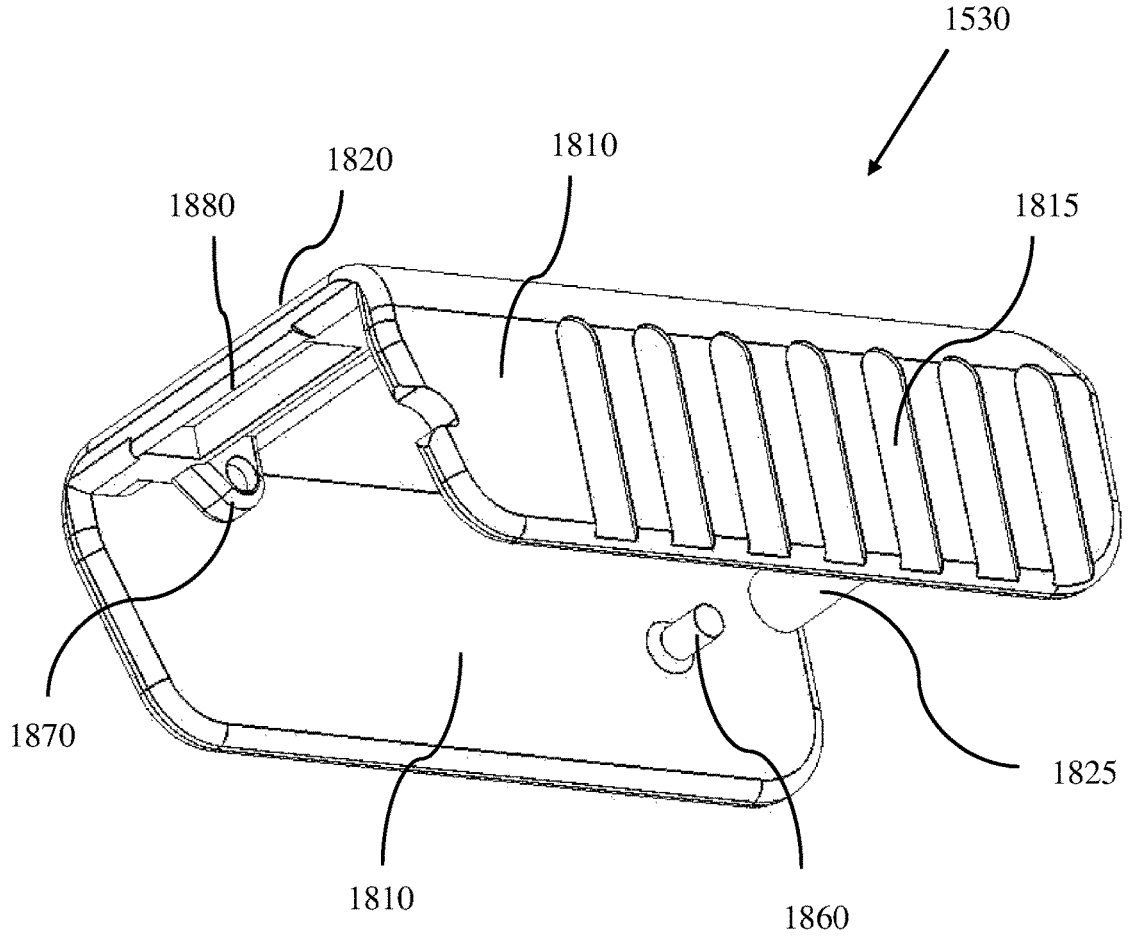
FIG. 18 is an illustration of a hood of the collapsible reflective sight according to the third exemplary preferred embodiment of the present invention.

Optionally, the recess 730 can be omitted if the external cover 320 is not used. Optionally, the hood 430 can include other external recesses or texturing to aid a user's grip as illustrated in FIG. 18. For example, the vertical recesses can be used as a place to grip to pull back a firearm slide.

The hood 430 can also include a locking notch. As illustrated in FIG. 7, the locking notch 740 is at a forward portion of one of the sides 710. The locking notch 740 receives a protrusion of the locking switch 440 in the collapsed configuration, as shown in FIG. 4. The hood 430 is held into the collapsed configuration when the protrusion of the locking switch 440 is engaged with the locking notch 740, as will be further described below.

The locking notch 740 can be on one or both sides 710 of the hood 430 or located anywhere suitable to allow engagement with the locking switch 440.

Further, as shown, one or more lens tracks 750 can be included in the sides 710 of the hood 430. As illustrated in FIG. 7, lens tracks 750 are a groove recessed into each of the inside surface of the sides 710. Optionally, the lens tracks 750 can be cut as slots entirely through the width of the sides 710.

During assembly of the reflective sight, the tracking tabs 650 on the lens 420 are fit into the lens tracks 750. During movement of the lens 420 and hood 430 while the optical reflective sight is being deployed and collapsed, the tracking tabs 650 slide within the bounds of the lens tracks 750. In a track-follower scheme, the lens tracks 750 guide the lens 420 to end positions in the deployed and collapsed configurations. The lens tracks 750 can include a straight section and a locking section 755 at opposite ends of the tracks. As illustrated in FIG. 7, the locking section 755 is curved at one end of the track 750 with respect to the straight section and includes geometric features or detent to secure the tracking tabs 650 and the lens 420 in place with respect to the hood 430 while the collapsible reflective sight 300 is deployed.

Locking the lens 420 and hood 430 in place with respect to each other while deployed strengthens the arrangement. While the optical reflective sight 300 is deployed and locked in place, a user can force back a firearm slide 310 from the open side of the hood 430. This can be done with the off-hand not on the firearm grip. Optionally, a user can push the deployed optical reflective sight 300 into an object (e.g., body part, clothing, piece of gear, sturdy object, etc.) to force back the slide 310 with one hand on the grip if the hand not on the grip is otherwise occupied or indisposed.

The hood 430 also includes spring bosses on the inside surface of the sides 710. As shown in FIG. 7, spring bosses 760 protrude inward from the inside of the sides 710. The spring bosses 760 can be integrally formed with the hood 430 or sides 710, but alternatively can formed separately and attached to the sides 710. Alternatively, the spring bosses 760 can be rivets, fasteners, inserts, or the like.

During assembly, the spring bosses 760 are fit into the recesses 545 on both sides of the base 410 and interact with the springs 580 for spring-assisted opening, as previously discussed with respect to FIG. 5.

As previously mentioned, the hood 430 includes a cross member 720. The cross member 720 at the forward portion of the hood 430 provides structural support across the top of the hood 430 and connects the two sides 710, as shown in FIG. 7. The cross member 720 is configured to allow an opening at the top of the hood 430. The opening provides for an unimpeded line of sight from a user's eyes through the hood 430 to the lens 420 when the collapsible optical sight is in the deployed position.

At a rear portion, the hood 430 includes a mounting bar 725. The mounting bar 725 spans between and provides additional structural support to connect the two sides 710. The mounting bar 725 can be integrally formed with the hood 430 or sides 710, but alternatively can be formed separately and attached to the sides 710 as a pin, rod, dowel, or the like.

The mounting bar 725 can be entirely cylindrical or include cylindrical features. During assembly, the mounting bar 725 is fit into the mounting slots 550 on the base 410. The arrangement allows the hood 430 to pivot along an axis parallel or substantially parallel within manufacturing tolerances to a long axis of the mounting bar 725. Alternatively, the mounting bar 725 can be cylindrical only at the portions where the mounting bar 725 is fit into the mounting slots 550.

Figure 8A:
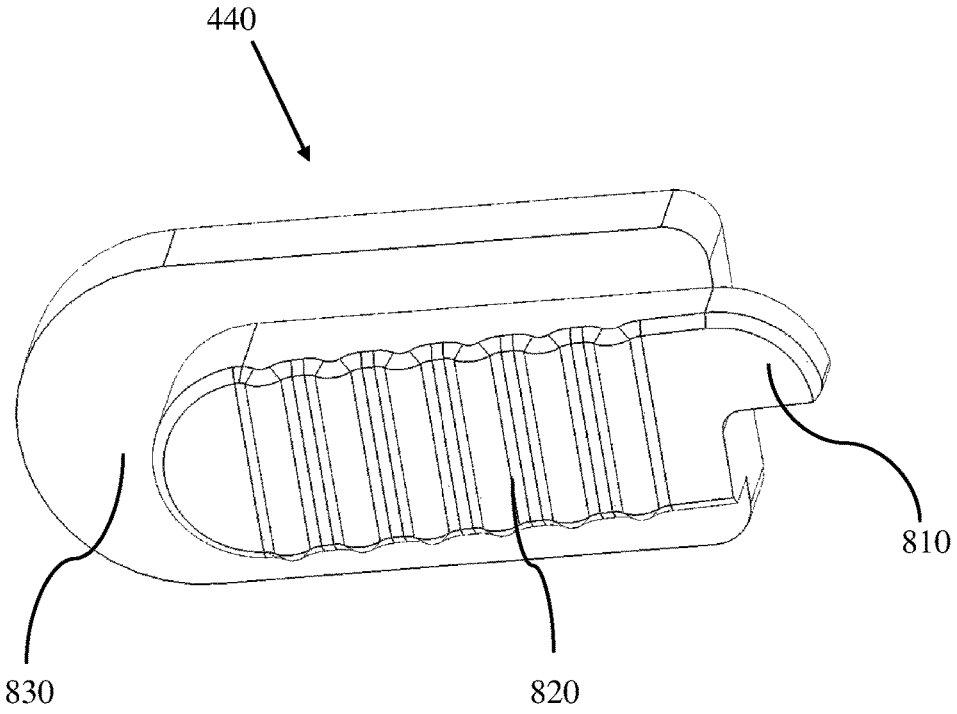
FIGS. 8A and 8B are views illustrating a locking switch of a collapsible reflective sight according to the first exemplary preferred embodiment of the present invention.

FIG. 8A illustrates a detailed view of a locking switch 440 shown in FIG. 4. As illustrated in FIG. 8A, the locking switch 440 includes a protrusion 810, a grip 820, and a glide 830. As shown in FIG. 4, the grip 820 is nominally flush with an outer surface of the slide 310. As shown in FIG. 8A, the glide 830 is larger than the grip 830 and is located behind a cutout in the slide 310. The locking switch 440 is spring loaded, forcing the locking switch 440 toward the hood 430, but is free to move back and forth within the slide cutout with applied pressure.

The locking switch 440 can be fabricated from metal, ceramic, composite, plastic, or any other material suitable to lock and unlock the collapsible reflective sight, as further described below.

As described above, the protrusion 810 is engaged into the locking notch 740 of the hood 430 when the collapsible reflective sight 300 is in the collapsed configuration. The protrusion 810 is geometrically shaped to fit into the locking notch 740. As illustrated in FIG. 8A, the protrusion 810 includes a flat bottom surface to mate with a flat surface in the locking notch 740 to hold the hood 430 down against the loading of the springs when in the collapsed position. The protrusion 810 can also include a rounded top surface to engage with the hood 430 and force the locking switch 440 out of the way when the hood 430 is being depressed while collapsing the reflective sight. Once fully depressed, the lower portion of the hood clears the locking switch 440 and the protrusion 810 fits into the locking notch 740 to lock down and retain the hood 430 in the collapsed configuration.

Figure 8B:
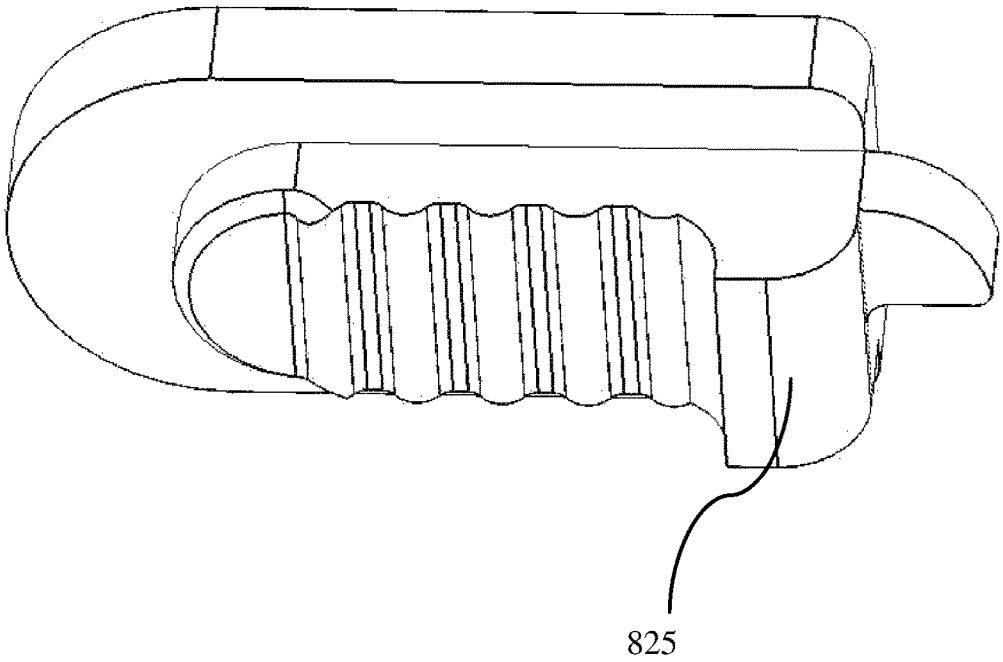

The grip 820 provides recessed, indented, undulated, rough, or textured features on the outer surface to provide a non-slip surface. Alternatively, the grip 820 can include a protrusion 825, as illustrated in FIG. 8B. These features of the grip 820 increase friction or surface area to make it easier for a user's thumb or finger to engage and move the locking switch 440 to release the lens 420 and hood 430 against the spring loading and into the deployed configuration.

Alternatively, the locking switch 440 can also be used to turn on and off the light source. For example, the reflective sight components can be configured such that when the locking switched 440 is engaged by a user and when the reflective sight is deployed, the light source turns on. On the other hand, collapsing the collapsible reflective sight 300 can turn off the light source.

Figure 9:
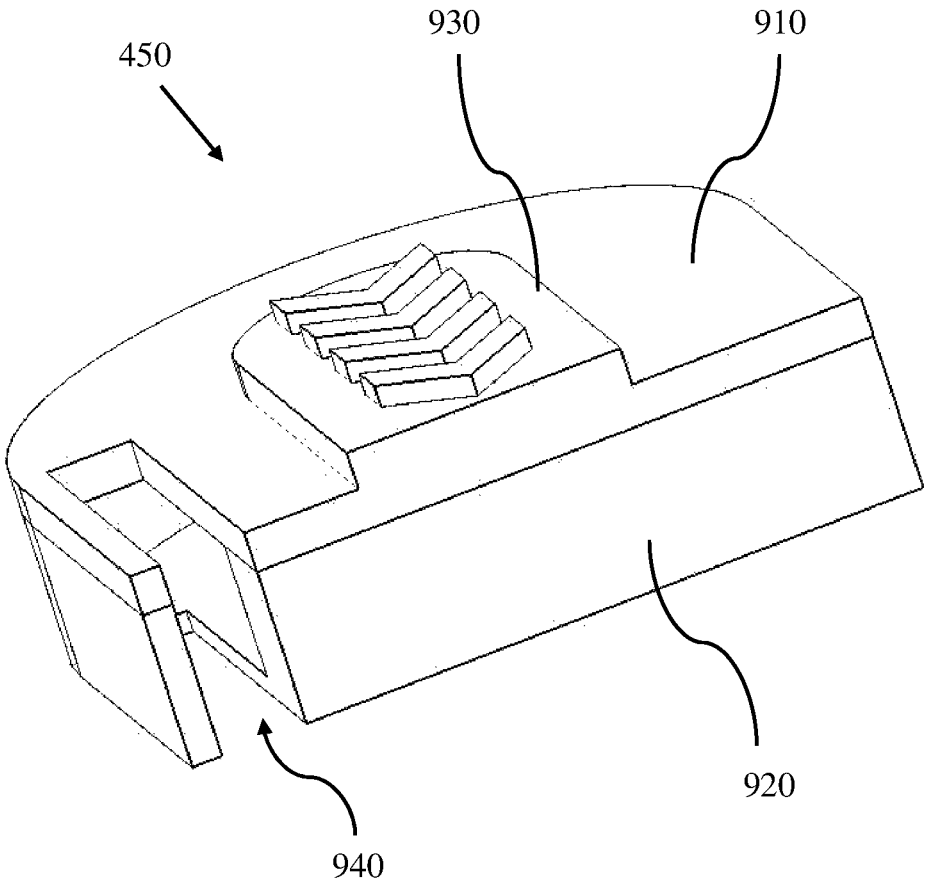
FIG. 9 is an illustration of a battery holder of a collapsible reflective sight according to the first exemplary preferred embodiment of the present invention.

FIG. 9 illustrates a perspective view of the battery holder 450. As illustrated, the battery holder can include a cover 910 and a case 920 to provide a space to hold a battery used to power the light source. The cover 910 and the case 920 can be separated and re-joined for access to the internal space for assembly and battery maintenance.

The battery holder 450 can be fabricated from metal, ceramic, composite, plastic, or any other material suitable for the purpose of retaining, connecting to, and mounting the battery to the collapsible reflective sight 300, as further described below.

The cover 910 can include a flat external top surface and a step 930 protruding above the top surface. As illustrated in FIG. 4, the top surface can be aligned flush with a top surface of the slide 310. The step 930 can also include indented, undulated, rough, or textured features on the outer surface to provide a non-slip surface. These features of the step 930 make it easier for a user's thumb or finger to engage and move the battery holder 450 in and out of its retained location.

In this configuration, the battery holder 450 is located in a space under the top of the slide 310. The geometric shape of a forward portion of the protruding step 930, for example, a semicircle, mates with a corresponding shape in the slide 310 to facilitate alignment and retention of the battery holder 450 to the firearm.

The battery holder 450 can be retained to the firearm by any method suitable, which can include fasteners, press-fit, retention cover, spring mechanism, or adhesive. Optionally, the battery holder 450 can be integrated with the base or mounted in another suitable location, for example, under the base 410.

Optionally, the cover 910 can include an internal lip or keyed geometric feature to facilitate alignment and sealing with the cover 920.

The case 920 mates with the cover 910 and receives a battery or a series of batteries used to power the light source. For example, as illustrated in FIG. 9, the case 920 can be shaped to receive a disk battery (not shown), but other battery types can also be accommodated.

The interior of the battery holder 450 can include battery contacts and wiring for routing the battery power to the light source.

The cover 910 and/or case 920 can include an opening 940 used to route wiring from the battery inside the battery holder 450 to the light source. After the battery is installed, the opening 940 and the battery holder 450 can be potted or otherwise sealed to isolate the battery and interior electrical contacts from exterior moisture, dirt, and other contaminants.

Optionally, the interface between the cover 910 and the base 920 can include an O-ring or other integrated environmental seal. Optionally, wiring from the battery can be routed through a grommet or elastomeric seal at the opening 940. Optionally, contacts or a connector can be mounted on the exterior of the battery holder 450 to facilitate power connection and wire routing from the battery to the light source. Optionally, the battery holder 450 or exterior mounted contacts can be spring loaded to facilitate connection/disconnection to/from the light source wiring. Optionally, the battery holder 450 can include controls to turn on and off the light source and/or to adjust the light source output.

Figure 10:
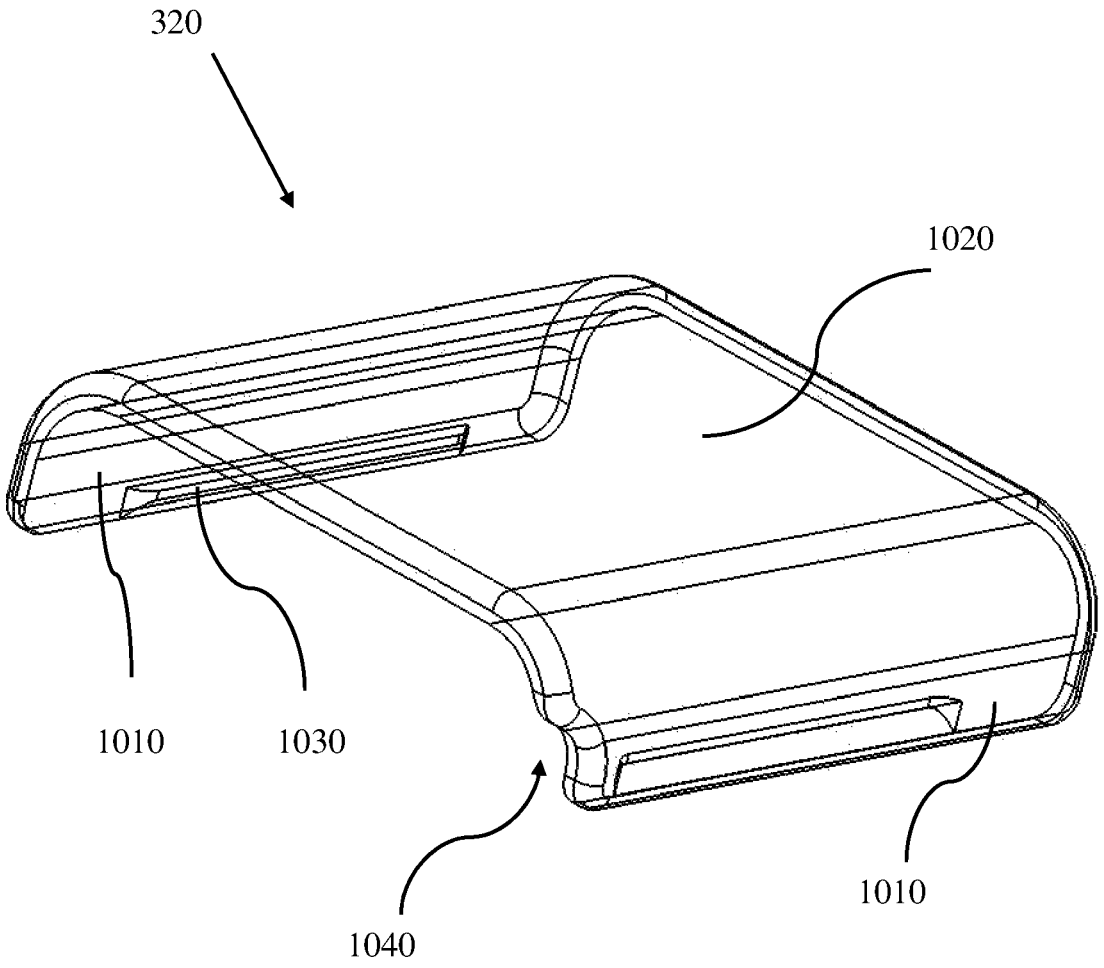
FIG. 10 is an illustration of an external cover of the collapsible reflective sight according to the first exemplary preferred embodiment of the present invention.

As previously mentioned, with respect to FIG. 3A, optionally the collapsible optical reflective sight 300 can include an external cover 320 for protection. An external cover 320 is illustrated in FIG. 10. The external cover 320 can include features to allow it to be temporarily or permanently mounted to the collapsible reflective sight 300.

The external cover 320 can be fabricated from metal, ceramic, composite, plastic, elastomeric, or any other material suitable and can be slightly flexible for the purpose of mounting to and protecting the collapsible reflective sight 300, as further described below. The external cover 320 can be either translucent or opaque.

As illustrated in FIG. 10, the external cover 320 is generally an inverted U-shape to conform to the hood 430. As shown, the external cover 320 includes two sides 1010 and a cross member 1020. The cross member 1020 provides structural support across the top of the external cover 320 and connects the two sides 1010. The connection between the two sides 1010 and the cross member 1020 can be rounded as shown.

For temporary mounting, the external cover 320 can include mounting tabs 1030 on the inside of the two sides 1010. As previously described, the mounting tabs 1030 are meant to mate with the external recesses 730 on the sides of the hood 430 such that the external cover snaps into place on the hood 430. The mounting tabs 1030 are indented into the recesses 730 which helps to hold the external cover 320 into place. The external cover 320 should be rigid enough to provide protection without falling off, but also flexible enough such that a user can mount and dismount the cover with a minimal amount of force without breaking the cover.

For permanent mounting, the external cover 320 can be adhered, bonded, or fastened to the hood 430.

The external cover 320 can also include a notch 1040 for clearance from the locking switch 440.

When mounted, the external cover 320 can provide several modes of protection for the collapsible reflective sight 300. The opening in the top of the hood 430 in the collapsed configuration allows the internal portions of the reflective sight 300 to be venerable. When employed in the collapsed configuration, the external cover 320 expands over the collapsible reflective sight 300 and covers the opening in the top of the hood 430 and will take the brunt of any impact. Thus, the external cover 320 can provide protection from external shock or impact made directly to the reflective sight 300. The external cover 320 can also protect the reflective sight components from the environment including rain, snow, splash, dust, and dirt.

If the external cover 320 is damaged beyond usefulness, it can simply be discarded and replaced.

Figure 11:
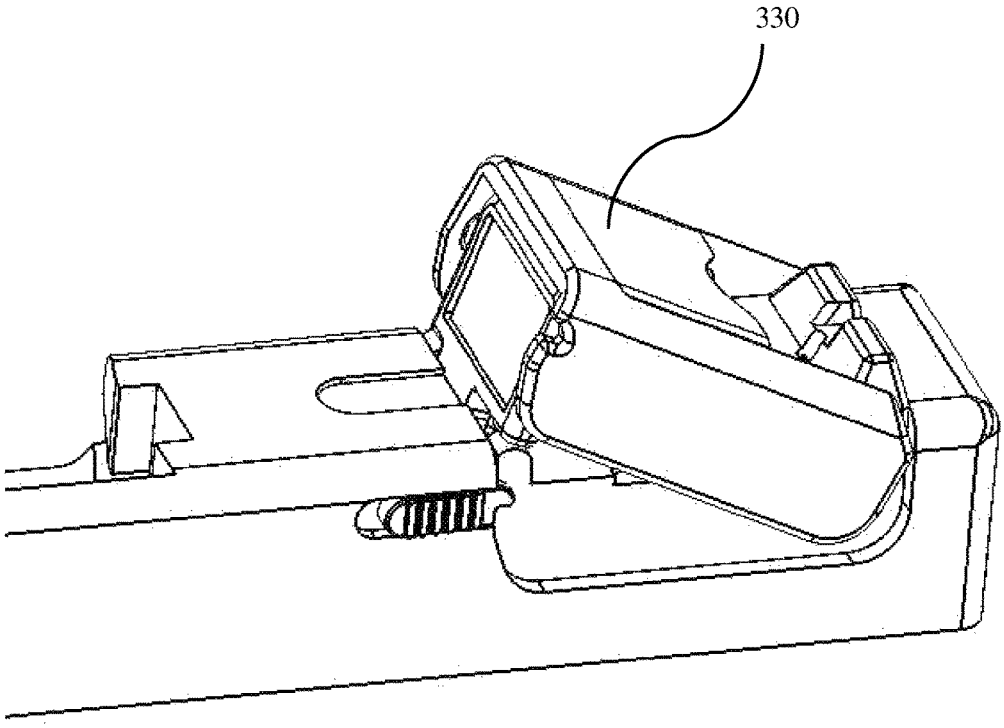
FIG. 11 is an illustration of the first exemplary preferred embodiment of the present invention of the collapsible reflective sight including an internal cover.

In another aspect of an exemplary preferred embodiment of the present invention, the reflective sight 300 can include an internal cover 330, as illustrated in FIG. 11. The internal cover 330 can be used with or without the external cover 320 and augment or perform the same protective functions as the external cover 320.

Similar to the external cover 320, the internal cover 330 can be fabricated from metal, ceramic, composite, plastic, elastomeric, or any other material suitable and can be slightly flexible for the purpose of mounting to and protecting the collapsible reflective sight 300 in the same manner as the external cover 320. Like the external cover 320, the internal cover 330 can be either translucent or opaque. Also, like the external cover 320, the internal cover 330 can be either temporarily pressed into place and removed by a user or permanently adhered, bonded, or fastened into place.

As illustrated in FIG. 11, the internal cover 330 can be attached to the top of the hood 430 between the sides 710 and adjacent to the cross member 720 and cross bar 725. The hood 430 can include any steps, recesses, grooves, slots, or other geometric features necessary to accommodate mounting the internal cover 330.

Figure 12:
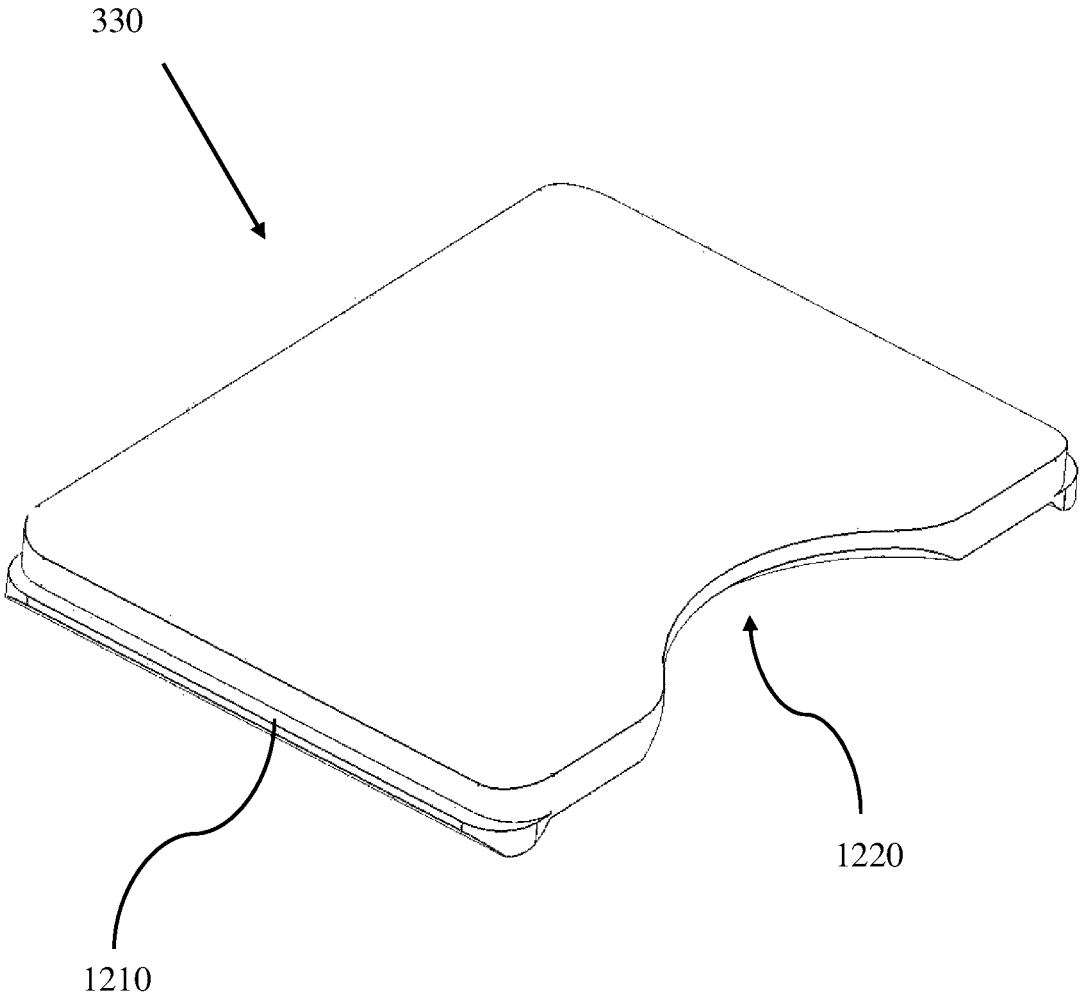
FIG. 12 is an illustration of an internal cover of the collapsible reflective sight according to the first exemplary preferred embodiment of the present invention.

As illustrated in FIG. 12, the internal cover 330 is rectangular or substantially rectangular to correspond with the rectangular or substantially rectangular opening in the hood 430. As shown in FIG. 12, the internal cover 330 also can include steps 1210 or features used to interface with and mount to the hood 430. The internal cover 330 can also include a scalloped feature 1220 to allow a user to grip the internal cover 330 during insertion and removal.

Either or both of the external cover 320 and internal cover 330 can also provide optical protection. If opaque, the covers 320, 330 can block light emitted from the light source if the light source is turned on in the collapsed configuration. This can be useful to significantly reduce or minimize a user's light signature to help avoid detection. If the covers 320, 330 are translucent they can be used as an optical filter. This can be helpful to alter the light source output. As an example, the covers 320, 330 can be used with the optical reflective sight 300 in the deployed configuration such that light from the light source reflected off the lens is filtered by one or both of the covers 320, 330 before reaching the user. For instance, the external cover 320 can be used as a night-vision compatibility filter. The external cover 320 can be used to make the light source compatible with a night-vision imaging system (NVIS) worn by a user or removed and not used when the user is not using NVIS.

Also, the covers 320, 330 can be used for enhancing the contrast and viewability of the dot. Such enhancement can include linear or circular polarization, antireflection, or tinting. Optionally, the covers 320, 330 can be photochromic or light-adaptive and can change the degree of tint based on ambient light conditions.

Second Preferred Embodiment

Figure 13A:
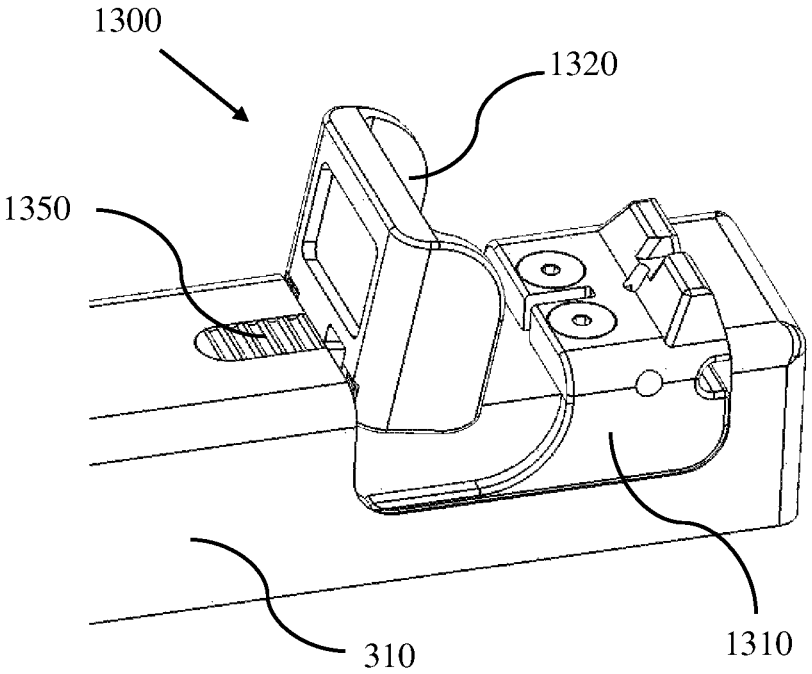
FIG. 13A is an illustration of a perspective view of a collapsible reflective sight for a firearm in a deployed configuration according to a second exemplary preferred embodiment of the present invention.
Figure 13B:
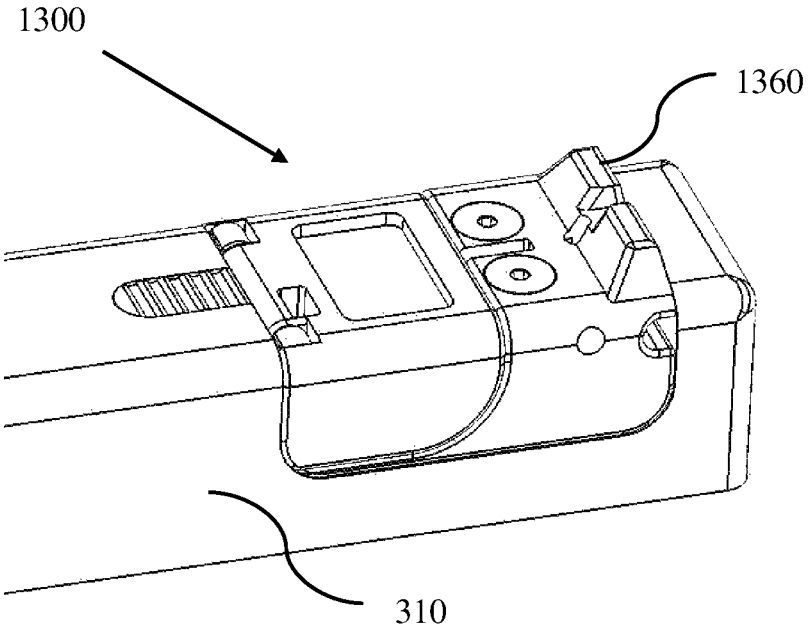
FIG. 13B is an illustration of a perspective view of an exemplary collapsible reflective sight for a firearm in a collapsed configuration according to the second exemplary preferred embodiment of the present invention.

FIGS. 13A and 13B illustrate a perspective view of a collapsible optical reflective sight 1300 mounted on a firearm slide 310, in accordance with a second exemplary preferred embodiment of the present invention. FIG. 13A illustrates the collapsible optical reflective sight 1300 in the deployed configuration. FIG. 13B illustrates the collapsible optical reflective sight 1300 mounted on the firearm slide 310 in the collapsed configuration. Reflective targeting of the light source dot of the second preferred embodiment operates the same as that of the first preferred embodiment.

A discussion of details similar to the first preferred embodiment will be omitted for brevity. Discussion below is directed to the overall configuration and differences from the first preferred embodiment.

As illustrated in FIG. 13B, in the collapsed configuration, like the first preferred embodiment, the collapsible optical reflective sight 1300 is low profile, fits within the original outline profile of the hand-gun slide 310, and includes a rear component of a mechanical or iron sight 1360.

As illustrated in FIG. 13A, also like the first preferred embodiment, the collapsible reflective sight 1300 of the second preferred embodiment includes a modular base 1310, a lens 1320, a battery holder 1350, and a spring (not shown) to assist to lens in deployment. However, unlike the first preferred embodiment, the second preferred embodiment does not include a hood. As configured, the second preferred embodiment can optionally benefit from protection by an external cover (not shown), as described above. In this preferred embodiment, the external cover can attach to the lens 1320.

Figure 14:
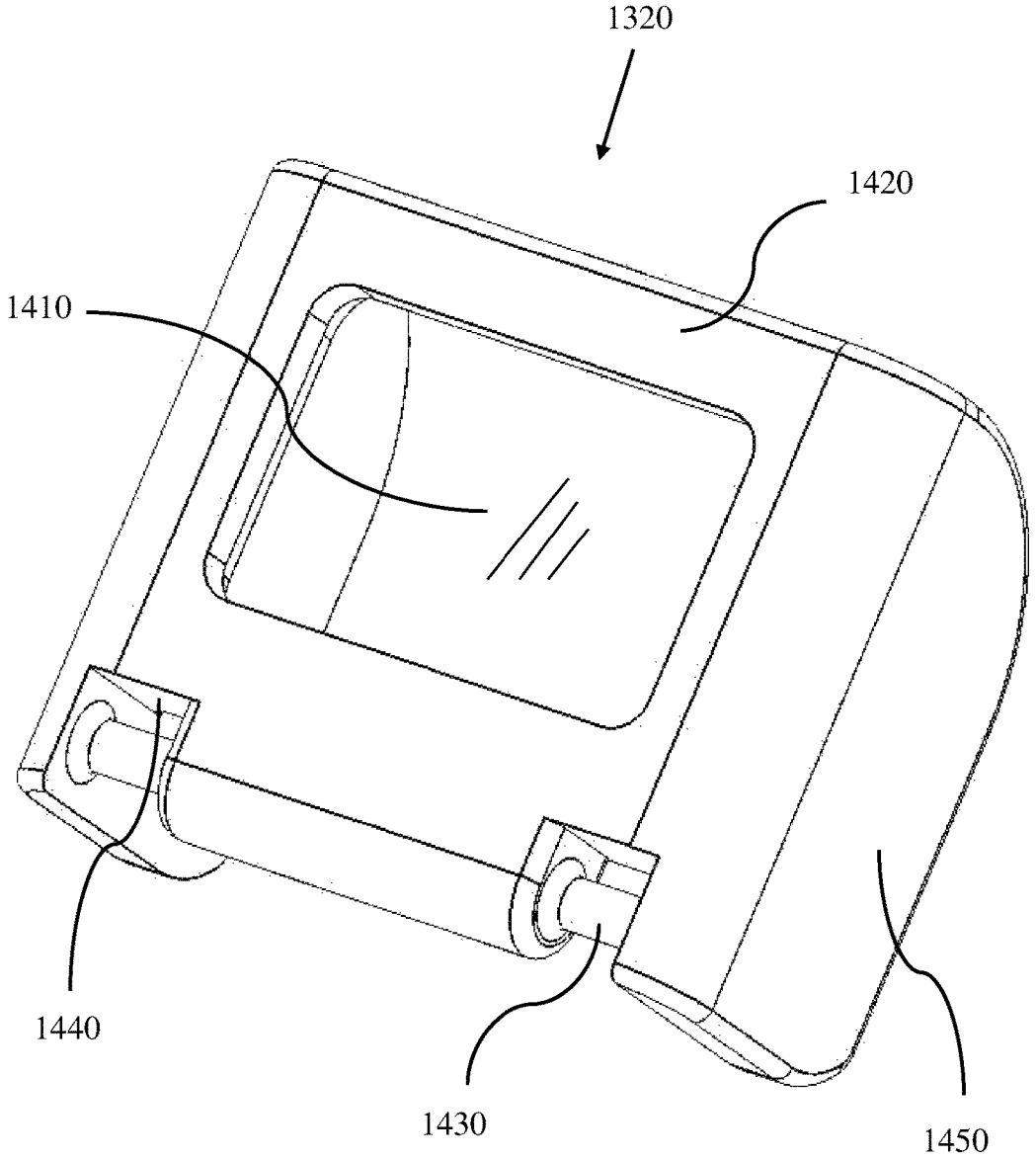
FIG. 14 is an illustration of a lens of the collapsible reflective sight according to the second exemplary preferred embodiment of the present invention.

FIG. 14 is a perspective view of the lens 1320. As illustrated in FIG. 14, the lens 1320 includes a window or optic 1410 and a frame 1420 for holding and protecting the optic 1410.

As illustrated in FIG. 14, the frame 1420 includes pivot tabs 1430. The pivot tabs 1430 are at a lower portion of the frame 1420 and mate with the lens mounting slots of the base 1310 as previously described above. The pivot tabs 1430 are preferably rounded so that they allow the lens 1320 to rotate within the mounting slots; thus, allowing the lens 1320 to rotate with respect to the base.

The pivot tabs 1430 can be integrally formed as part of the frame 1420 or alternatively be formed with pins, as previously described.

The lower portion of the frame 1420 can also include spring retaining features. As illustrated in FIG. 14, spring retaining features include surfaces 1440 near each of the pivot tabs 1430. The surfaces 1440 can contact with an end of spring as previously described. The other end of the spring can contact one of a surface of the slide 310, the base 1310, or the battery compartment 1350.

It is intended that the spring be oriented such that it is in a higher compressed state when the lens 1320 is lying flat in the base 1310 in the collapsed configuration than when the lens 1320 is rotated at an angle with respect the base 1310 in the deployed configuration. The compressed spring forces rotation of the lens 1320 into the deployed configuration, as shown in FIG. 13A. Although not shown, the reflective sight 1300 of the second preferred embodiment can include a locking switch to retain the lens 1320 against the force of the springs in the collapsed configuration, as previously described.

The frame 1420 provides structural support for the window 1410 and also includes sides 1450 that extend perpendicular or substantially perpendicular to the window 1410. The sides 1450 provide additional structural support for the lens 1320. As illustrated in FIGS. 13A and 13B, the sides of the lens 1320 conform to a cutout in the slide 310 and the base 1310. Once in the collapsed configuration, as shown in FIG. 13B, the lens 1320 fits within the profile of the slide 310 and the base 1310.

When deployed, as shown in FIG. 13A, the lens 1320 is oriented at an angle with respect to the top of the slide 310, and bottom portions of the sides 1450 of the frame 1420 remain below a top surface of the base 1310. In this configuration, the sides 1450 of the frame 1420 can support the lens 1320 from being deflected or deformed from a side-to-side or torsional force. Inside surfaces of the sides 1450 of the frame 1420 on the side of the external force will contact a side of the base 1310 and prevent movement.

Although, the reflective sight 1300 of the second preferred embodiment will not have the fore and aft support of a hood like the first preferred embodiment, it can be appreciated that this can be a lower cost option with fewer components and require less assembly time. The low profile, structural integrity, and inclusion of the secondary mechanical sight are an improvement over the related art.

Third Preferred Embodiment

FIGS. 15-18 illustrate a collapsible optical reflective sight 1500 mounted on a firearm slide 310, in accordance with a third exemplary preferred embodiment of the present invention.

A discussion of details similar to the first and second preferred embodiments will be omitted for brevity. Discussion below is directed to the overall configuration and differences from the first and second preferred embodiments of the present invention.

Figure 15:
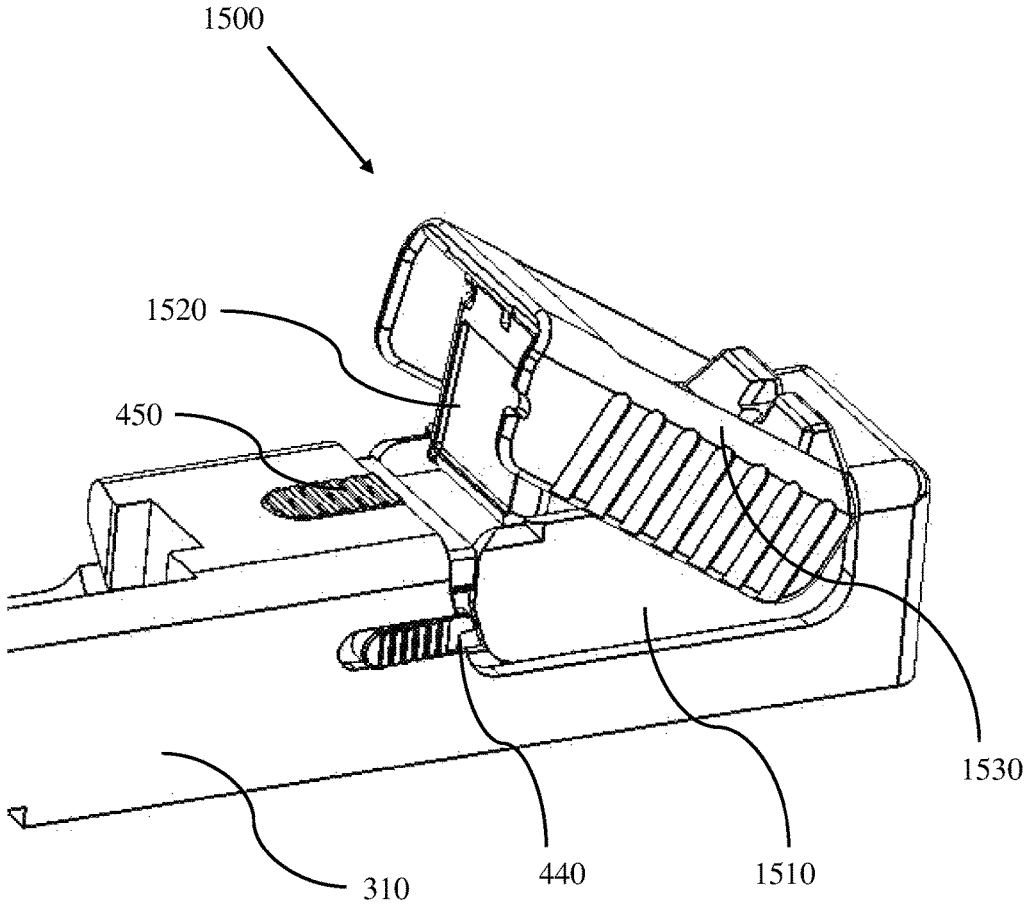
FIG. 15 is an illustration of a collapsible reflective sight in the deployed configuration according to a third exemplary preferred embodiment of the present invention.

As illustrated in FIG. 15, the collapsible reflective sight 1500 of the third preferred embodiment includes a modular base 1510, a lens 1520, a hood 1530, a battery holder 450, and a locking switch 440. As configured, the third preferred embodiment can optionally benefit from protection by an external cover (not shown) and/or an internal cover (not shown), as described above.

In the third preferred embodiment, the relative movement of the lens 1520 during deployment and collapsing with respect to the modular base 1510 and hood 1530 is different than in the first preferred embodiment. In the third preferred embodiment, the lens 1520 moves in a reverse pivot arrangement. That is, the lens 1520 pivots and rotates from the top at the hood 1530 rather than pivoting at the base 1510 as in the first preferred embodiment.

FIG. 16 is a perspective view of the modular base 1510. As illustrated, the base 1510 may include a body with two sides 1615 with inner and outer surfaces and a cross member 1620 defining a channel 1625 between the two sides 1615. As shown, the sides 1615 fit into a recessed cutout in the slide 310, and each side 1615 includes geometric features to mate with complementary features on the firearm. However, as previously described, the bottom of the base 1510 can be flat or can include features for rail attachment or any other mounting scheme. In FIG. 16 the heads of the mounting screws are visible as inserted into the two screw holes.

In this preferred embodiment, each side 1615 extends above the cross member 1620 and includes a lens track 1650 on an inner surface above the cross member 1620. As illustrated in FIG. 16, lens tracks 1650 are a groove recessed into each of the inside surfaces of an upper portion of the sides 1615. Optionally, the lens tracks 1650 can be cut as slots entirely through the width of the sides 1615.

As shown in FIG. 16, the upper portion of the two sides 1615 and the upper surface of the cross member 1620 define a pocket in which the lens 1520 will fold into in the collapsed configuration.

A spring 1670 retained with a fastener 1675 used to assist the hood 1530 to deploy are also shown in FIG. 16.

The base 1510 can be fabricated from metal, ceramic, composite, plastic, or any other material suitable for the purpose of mounting the collapsible reflective sight 1500 and retaining the other components, as described below.

Figure 17:
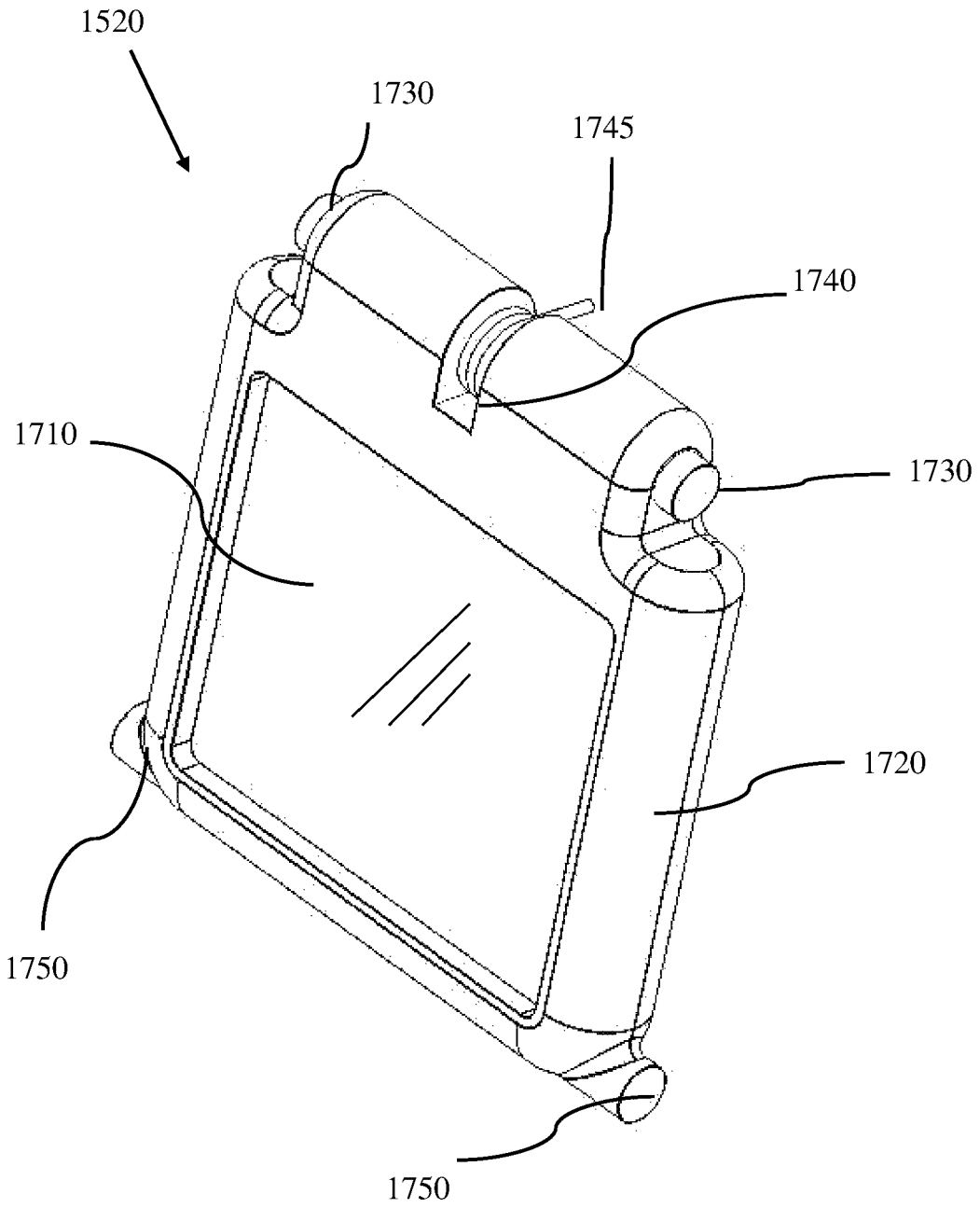
FIG. 17 is an illustration of a lens of the collapsible reflective sight according to the third exemplary preferred embodiment of the present invention.

As illustrated in FIG. 17, the lens 1520 includes a window or optic 1710 and a frame 1720 to hold and protect the window 1710. In this preferred embodiment, the pivot tabs 1730 are located at an upper portion of the frame 1720. The pivot tabs 1730 mate with the lens mounting bore of the hood 1510, as will be described below. The pivot tabs 1730 are preferably rounded so that they allow the lens 1520 to rotate within the mounting bores; thus, allowing the lens 1520 to rotate with respect to the base 1510. The pivot tabs 1730 can be integrally formed as part of the frame 1720 or alternatively be formed with pins, as previously described.

The upper portion of the frame 1720 can also include spring retaining features. As illustrated in FIG. 17, a spring retaining feature 1740 includes a groove but may include other features. The groove is cut to allow a coil of a spring 1745 to wrap around the axis of rotation of the pivot tabs. One end of the spring 1745 contacts the hood 1530 to create a force between the lens 1520 and the hood 1530 for spring-assisted deployment, as previously described.

The bottom portion of the lens 1520 includes tracking tabs 1750 on two sides of the frame 1720. The tracking tabs 1750 are features that travel within the track 1650 located in the base 1510, as described above.

A perspective view of the hood 1530 of the third preferred embodiment is illustrated in FIG. 18. As illustrated, the hood 1530 has generally an inverted U-shape with two corresponding opposite sides 1810 defining the sides of the U-shape and a cross member 1820 and mounting bar 1825 connecting the sides 1810 defining the base of the U-shape. A series of vertical recesses 1815 for aid in gripping is also shown.

The hood 1530 can be fabricated from metal, ceramic, composite, plastic, or any other material suitable for the purpose of protecting the lens, light source, and other components when the gun sight is in the collapsed configuration. The hood 1530 provides structural support when the optical reflective sight 1500 is deployed, as was described above.

As illustrated in FIG. 18, at the underside of the cross member 1820 are mounting features to capture the pivot tabs 1730 and to mount the lens 1520. The mounting features can include a flange 1870 with a counter bore in which the pivot tabs 1730 are inserted and allowed to rotate.

A magnet recess 1880 is also illustrated on the underside of the cross member 1820 to retain a magnet (not shown) used to help hold down the hood 1530 in place while folded down and collapsed.

During assembly of the optical reflective sight 1500, the tracking tabs 1750 on the lens 1520 are fit into the lens tracks 1650, and the pivot tabs are inserted into the flange 1870. During movement of the lens 1520 and hood 1530 while the optical reflective sight is being deployed and collapsed, the tracking tabs 1750 slide within the bounds of the lens tracks 1650 on the base 1510. In a reverse pivot scheme, the lens tracks 1650 guide the lens 1520 to end positions in the deployed and collapsed configurations. The lens tracks 1650 can include a straight section and a locking section 1655 at opposite ends of the tracks. As illustrated in FIG. 16, the locking section 1655 is curved at one end of the track 1650 with respect to the straight section and includes geometric features or detent to hold the tracking tabs 1650 and lens 1520 in place while the collapsible reflective sight 1500 is deployed, strengthening the arrangement.

Fourth Preferred Embodiment

Figure 19A:
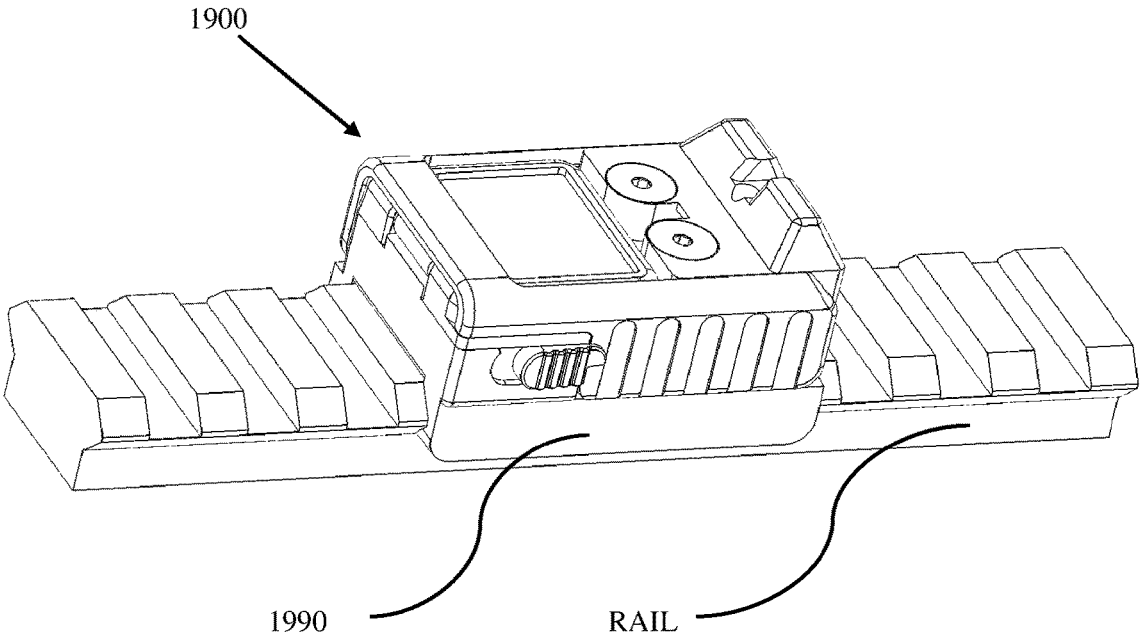
FIGS. 19A and 19B are illustrations of a perspective view of a collapsible reflective sight for a firearm in a deployed configuration according to a fourth exemplary preferred embodiment of the present invention.
Figure 19B:
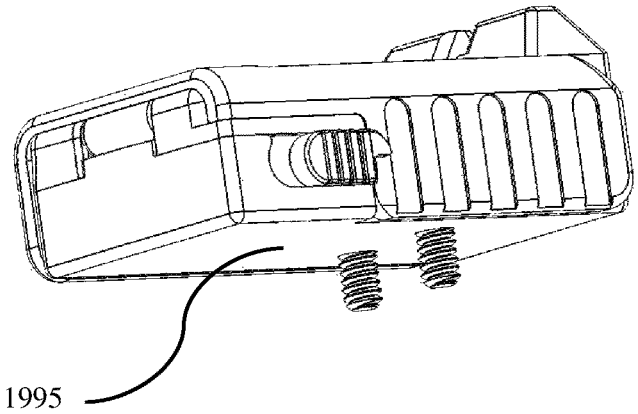

FIGS. 19A and 19B, illustrate perspective views of a fourth preferred exemplary embodiment of the present invention of a collapsible reflective gun sight 1900. A discussion of details similar to the first through third preferred embodiments will be omitted for brevity. Discussion below is directed to the overall configuration and differences from the first and second preferred embodiments.

As illustrated in FIGS. 19A and 19B, all components including the base, mechanical sight, lens, hood, light source, battery holder, battery, release switch, light source, springs, etc. are integrated within the optical reflective sight 1900 as one integrated assembly.

As illustrated in FIG. 19A, the base 1990 may be adapted to mount the optical reflective gun sight 1900 on a rail that is attached to a firearm. Rails are typically used with rifles or machine guns, but may be incorporated on a handgun. A rail offers a user flexibility in mounting accessories such as scopes, back-up sights, flash lights, laser pointers, handles, etc. Base 1990 can include a dove tail or other feature to mate with the particular rail style.

As illustrated in FIG. 19B, the base 1995 can be configured with a flat bottom to mount flush with a firearm slide, flat rail, or other portion of a firearm. The bottom portions of the mounting screws are shown protruding through the bottom of the base 1995. This configuration offers a universal mounting directly to a flat surface or adapter plate that can in turn be used to interface with rails or individual firearm models.

Figure 20:
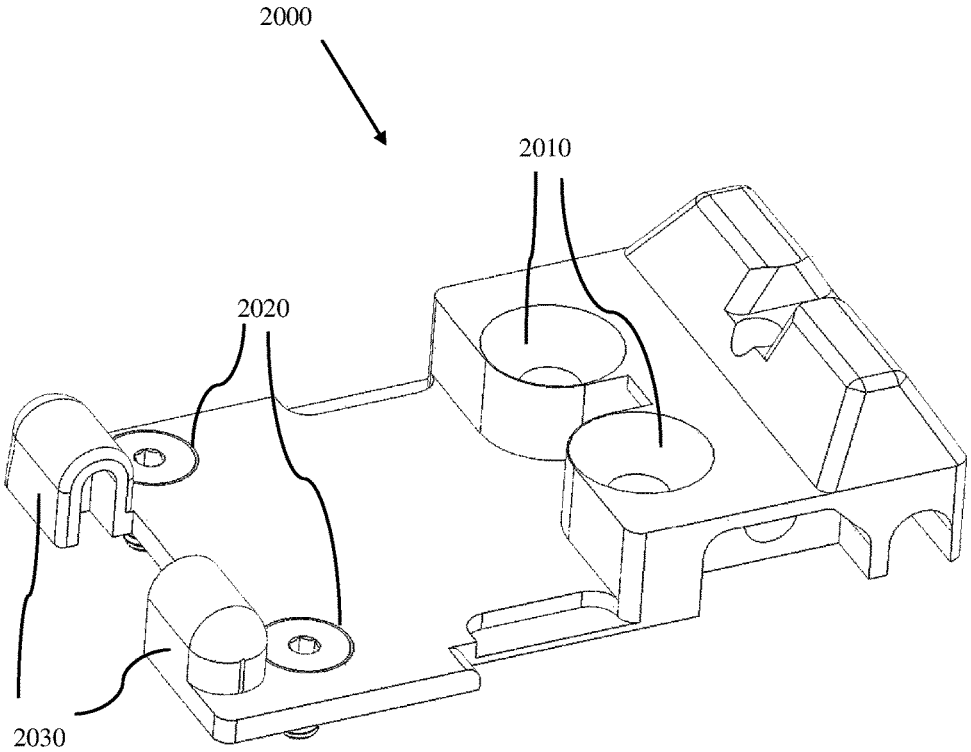
FIGS. 20 and 21 are illustrations of portions of the base of the collapsible reflective sight according to the fourth exemplary preferred embodiment of the present invention.
Figure 21:
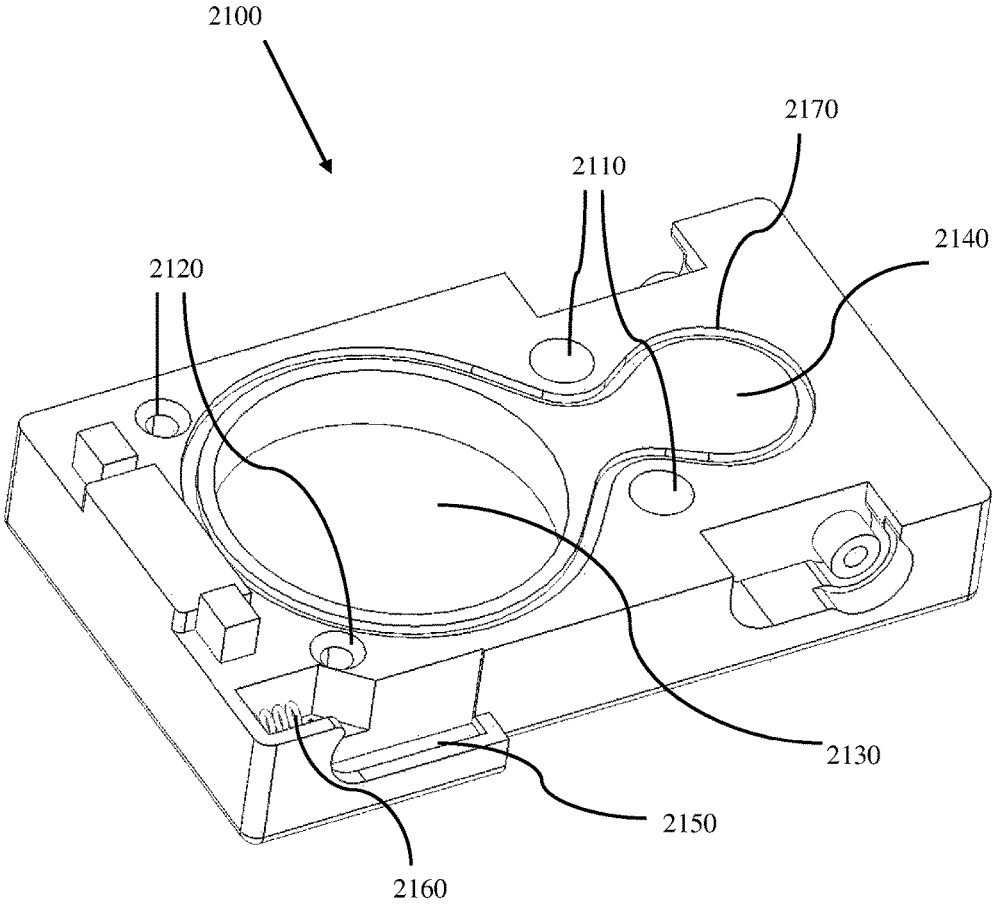

In this preferred embodiment, the base 1990 includes multiple pieces. FIG. 20 illustrates a top portion 2000 of the base 1990, and FIG. 21 illustrates a bottom portion 2100 of the base 1990. As illustrated in FIGS. 20 and 21, the top portion 2000 defines a cover for the bottom portion 2100.

As illustrated in FIG. 20, the top portion 2000 and bottom portion 2100 include features to attach to each other. As in the previously described preferred embodiments, the top portion 2000 includes screw holes 2010 used to route screws to mount the optical reflective sight 1900 to a firearm. The screws inserted through these holes 2010 also pass through holes 2110 in the bottom portion 2100, as will be further described below. The mounting screws through screw holes 2010 can directly or indirectly couple together the top portion 2000 and the bottom portion 2100.

The top portion 2000 also includes holes 2020 to mount screws used to attached the top portion 2000 directly to the bottom portion 2100, but are not used to mount the optical reflective sight 1900 to the firearm. In FIG. 20, two countersunk holes 2020 are shown with screws that fasten directly into threaded holes 2120 in the bottom portion 2100.

The top portion 2000 also includes features 2030 to retain the pivot tabs of a lens.

FIG. 20 illustrates the features that can be included in the bottom portion of the base 2100 in the fourth preferred embodiment. As mentioned above, screws used to mount the optical reflective sight 1900 to a firearm pass through holes 2110. Holes 2110 can be threaded. Threaded holes 2120 are included for fastening the top portion 2000 to the bottom portion 2100.

The bottom portion of the base 2100 also can include a battery compartment 2130 recess to store a battery that powers the light source and a light source recess 2140 that retains the light source.

Also as shown in FIG. 21, the bottom portion of the base 2100 includes a locking switch groove 2150 to retain the locking switch and to allow movement back and forth to lock and unlock the components of the optical reflective sight 1900 as previously described with respect to the other preferred embodiments. A locking spring 2160 which applies pressure to lock the locking switch is also shown retained in a cavity of the bottom portion 2100. A sealing groove 2170 is also shown for use in sealing the battery compartment 2130 and light source recess 2140. The sealing groove 2170 can be used to retain an o-ring, gasket, potting material, or the like.

Fifth Preferred Embodiment

Figure 22A:
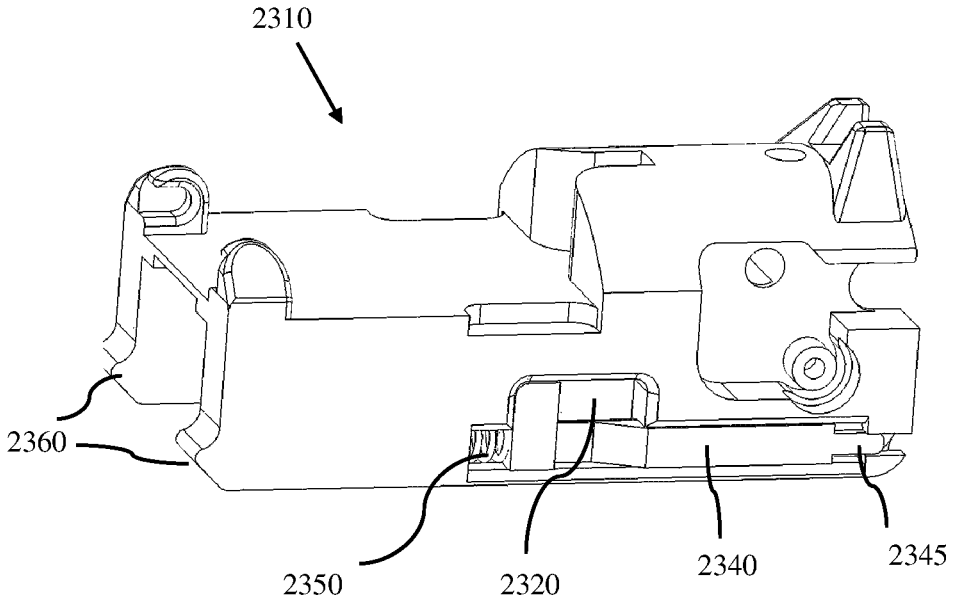
FIGS. 22A and 22B are views of a base of the collapsible reflective sight according to the fifth exemplary preferred embodiment of the present invention including a self-contained locking mechanism.
Figure 22B:
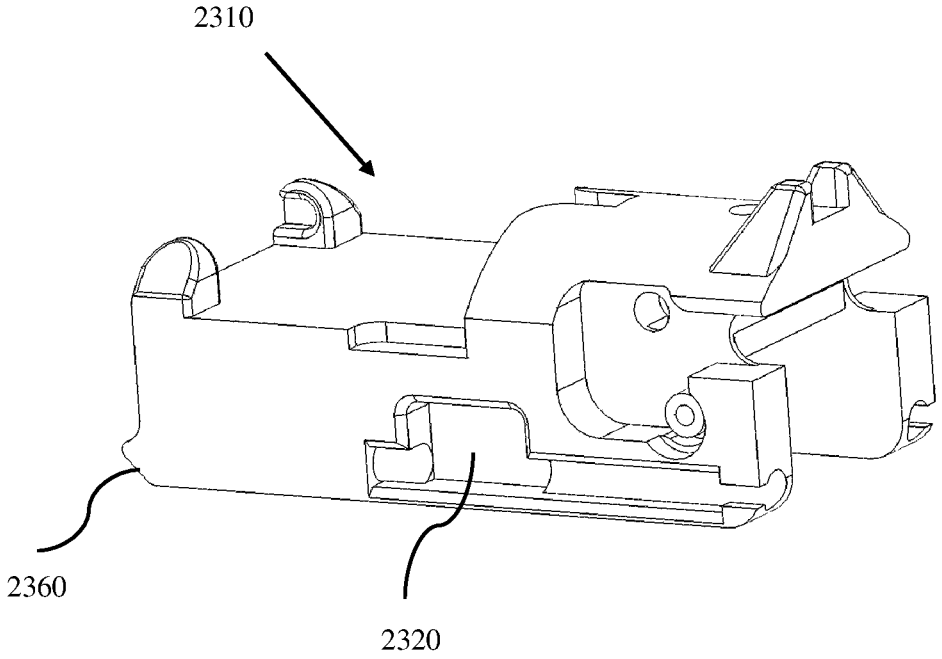

FIGS. 22A and 22B, illustrate perspective views of a fifth preferred exemplary embodiment of the present invention of a collapsible reflective gun sight. The fifth preferred exemplary embodiment is directed to a spring-assisted lock mechanism for mounting and unmounting the collapsible gun site from a firearm. Rather than using screws or fasteners with a hand tool to mount the collapsible reflective gun sight to a firearm, as previously described, the components of the lock mechanism are retained in the base and do not require separate parts or tools. As further described below, the locking mechanism fits into a recess in the base in a location where a user can hold the collapsible reflective gun sight and slide the locking mechanism with their fingers to engage or disengage the lock from the mounting position on the firearm. This system allows a user to more quickly mount and dismount a collapsible reflective gun sight from a firearm for replacement, repair, or to access the battery compartment, than previously described mounting methods.

A discussion of details similar to the first through fourth preferred exemplary embodiments will be omitted for brevity. Discussion below is directed to the overall configuration and differences from the first, second, third, and fourth preferred exemplary embodiments.

As illustrated in FIGS. 22A and 22B, the locking mechanism can include a recess or groove 2320 in the base 2310, a lock 2340, and a spring 2350. As illustrated, the base 2310 can optionally include protrusions 2360 at each of the front portions of the sides of the base 2310. The protrusions 2360 are preferably formed as part of the base 2310 and can fit into corresponding cut out portions of the slide, rail, adapter, or mounting position on the firearm.

The base 2310 also includes a recess 2320 in which the lock 2340 and spring 2350 are retained. FIG. 22B illustrates the recess 2320 with the lock 2340 and spring 2350 removed. The recess 2320 can be formed in base 2310 as a groove or slot with features configured such that the spring 2350 and lock 2340 are retained therein. As illustrated, the recess 2320 is located at lower portions of each side of the base 2310. Optionally, the recess 2320 and locking mechanism can be located on any portion of the base 2310, including the top or a single side, to allow the lock 2340 to engage with a receiving portion on the firearm.

As illustrated in FIG. 22A, the spring 2350 is compressed between the base 2310 and the lock 2340 to apply force to the lock 2340 to engage with the firearm. The spring 2350 is shown as a coil spring fit into the recess 2320, but can be any other type of spring suitable for the purpose. The lock 2340 is formed to fit into and be retained by the recess 2320 and can include portions to contact the spring 2350 and also form a bolt 2345 which provides the fastening or engagement by protruding from the base 2310 to engage a receiving portion on the firearm. The lock 2340, as illustrated in FIG. 22A is retracted, but as it can be appreciated that the lock 2340 is capable of sliding back and forth within the recess 2320. The force of the spring 2350 will push the lock 2340 in a direction to engage the bolt 2345 with the firearm.

To mount the collapsible reflective gun sight to a firearm with the spring-assisted lock shown in FIGS. 22A and 22B, a user can angle the base 2310 leading with the protrusions 2360 into the firearm and then either press down the rear of the base 2310 to force the lock 2340 back to clear the firearm before automatically engaging the bolt 2345 once clear, or physically retract the lock 2340 against the spring 2350 to allow the bolt 2345 to clear the receiving portion of the firearm before releasing tension on the spring 2350 and allowing the bolt 2345 to engage with the firearm. To disengage, a user can force the lock 2340 to compress the spring 2350 to retract the bolt 2345 far enough to clear the receiving portion of the firearm and lift the base 2310 away from the firearm out of its mounting location once the bolt 2345 is disengaged from the firearm.

Figure 23A:
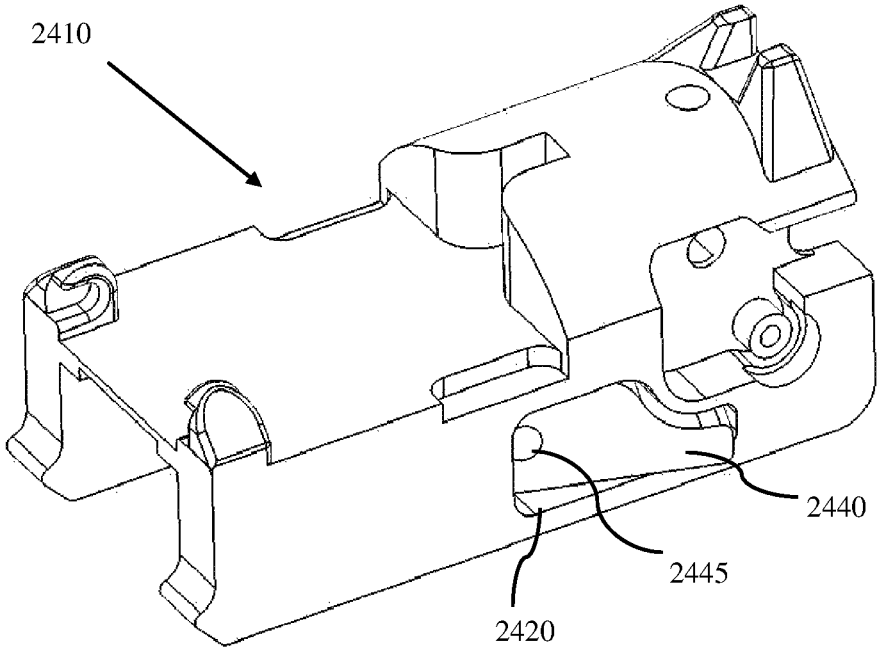
FIGS. 23A and 23B are views of a base of the collapsible reflective sight according to another aspect of the fifth exemplary preferred embodiment of the present invention including a self-contained locking mechanism.
Figure 23B:
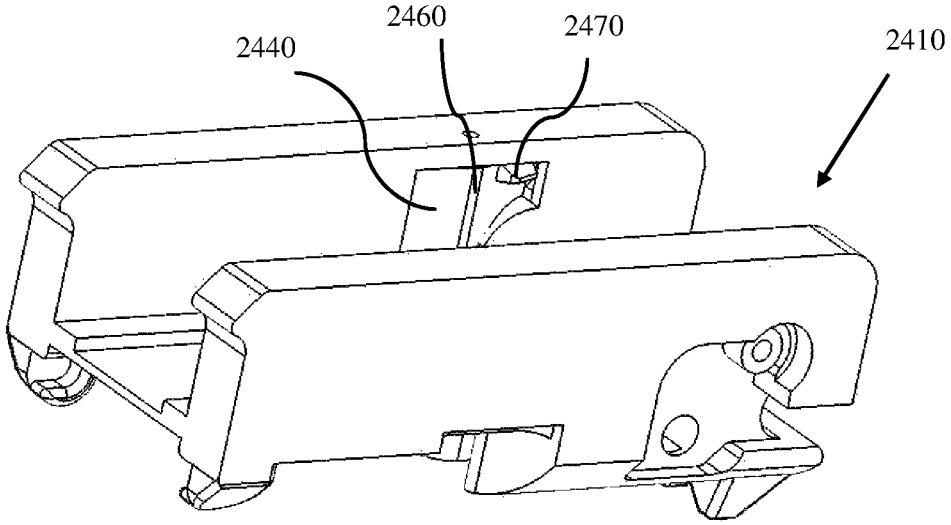

FIGS. 23A and 23B illustrate a spring-loaded lock in another aspect of the fifth preferred exemplary embodiment. FIG. 23A illustrates a base 2410 including a recess or groove 2420, a lock 2440, and spring (not shown). The lock 2440 includes a press locator 2445 used to assist a user in locating their finger onto an area at which to apply force to the lock 2440 to rotate the lock 2440 and unlock it from the slide or mounting adapter (not shown). The press locator 2445 can be a recess, protrusion, or textured area on the outside surface of the lock 2440 configured to feel different to a user's touch than the surface of the lock 2440. The spring puts tension on the lock 2440 to force the lock 2440 to be flat or flush relative to the base 2410.

FIG. 23B illustrates a view of the base 2410 showing the inside of the lock 2440. The inside surface of the lock 2440 includes a protrusion 2470 that protrudes into a corresponding groove or recess on the slide, rail, or mounting adaptor to hold the collapsible reflective gun sight to a firearm. FIG. 23B also shows a hinge 2460 used to mount the lock 2440 to the base 2410. The hinge 2460 also provides an axis in which the lock 2440 can pivot around when forced against the spring. The hinge 2460 can include a pin or fastener as a mechanism to retain the lock 2440 to the base 2410.

As shown in FIG. 23B, the hinge 2460 is vertical with respect to a length of the base 2410. A vertical orientation of the hinge 2460 requires force to be applied against the spring on the right or left side of the lock 2440 to disengage the protrusion 2470 from the mount. Optionally, the hinge 2460 can be oriented horizontally with respect to the length of the base 2410, in which case a user would need to apply force on the upper or lower portions of the lock 2440 to disengage the protrusion 2470. A horizontally oriented hinge 2460 provides the additional benefit that the protrusion 2470 can be extended in the horizontal direction and provide more surface area in which to engage the corresponding mounting groove 2420 because the sides of the base 2410 have more area in that direction.

Although FIGS. 23A and 23B show the spring-loaded lock 2440 located on one side of the base 2410, it should be appreciated that the lock 2440 can also be on both sides of the base 2410.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A collapsible reflective optical sight for a firearm, comprising:

a base configured to mount the optical sight to a firearm;

a lens attached to and able to rotate with respect to the base, wherein the lens includes a first optic with a reflective surface, and the lens is movable between a collapsed configuration in which the lens is folded down with respect to the base for storage and a deployed configuration in which the lens is angled with respect to the base for use in aiming the firearm;

a light source mounted to the base that reflects light off the reflective surface of the first optic to a user for aiming the firearm; and a hood directly rotatably mounted to the base and in continuous contact with an upper portion of the lens at all times; wherein the hood, in the collapsed configuration, folds over the lens and, in the deployed configuration, is angled with respect to the base and extends between the base and the upper portion of the lens, and the hood pivots on an axis perpendicular to a path of the light.

2. The collapsible reflective optical sight of claim 1, further comprising a spring configured to assist in moving the hood from the collapsed configuration to the deployed configuration.

3. The collapsible reflective optical sight of claim 2, further comprising a release switch configured to lock the lens and the hood in the collapsed configuration for storage and to release the lens from the collapsed configuration into the deployed configuration.

4. The collapsible reflective optical sight of claim 1, further comprising a mechanical sight for aiming the firearm.

5. The collapsible reflective optical sight of claim 4, wherein the mechanical sight is integral with the hood.

6. The collapsible reflective optical sight of claim 4, wherein the mechanical sight is integral with the lens.

7. The collapsible reflective optical sight of claim 4, wherein the mechanical sight is integral with the base.

8. The collapsible reflective optical sight of claim 4, wherein the mechanical sight includes an adjustable bore-sight.

9. The collapsible reflective optical sight of claim 4, wherein the mechanical sight is configured for aiming the firearm when the lens is in the deployed configuration.

10. The collapsible reflective optical sight of claim 1, wherein the base mounts the collapsible reflective optical sight to an adapter plate.

11. The collapsible reflective optical sight of claim 1, wherein the upper portion of the lens is guided in a track in the hood when the lens is moved between the deployed and collapsed configurations; and the hood secures the lens in place with respect to the hood and the base in the deployed configuration.

12. The collapsible reflective optical sight of claim 1, wherein the upper portion of the lens rotates with respect to the hood;

a lower portion of the lens is guided in a track in the base when the lens is moved between the deployed and collapsed configurations; and the base secures the lens in place with respect to the hood and the base in the deployed configuration.

13. The collapsible reflective optical sight of claim 1, wherein the light source includes an adjustable boresight.

14. A collapsible reflective optical sight for a firearm, comprising:

a firearm;

a base configured to mount the optical sight to a firearm;

a lens attached to and able to rotate with respect to the base, wherein the lens includes a first optic with a reflective surface, and the lens is movable between a collapsed configuration in which the lens is folded down with respect to the base for storage and a deployed configuration in which the lens is angled with respect to the base for use in aiming the firearm;

a light source mounted to the base that reflects light off the reflective surface of the first optic to a user for aiming the firearm; and a hood directly rotatably mounted to the base and in continuous contact with an upper portion of the lens at all times; wherein the hood, in the collapsed configuration, folds over the lens and, in the deployed configuration, is angled with respect to the base and extends between the base and the upper portion of the lens, and the hood pivots on an axis perpendicular to a path of the light.

15. The collapsible reflective optical sight of claim 14, further comprising a mechanical sight for aiming the firearm.

16. The collapsible reflective optical sight of claim 15, wherein the mechanical sight is integral with the hood.

17. The collapsible reflective optical sight of claim 15, wherein the mechanical sight is configured for aiming the firearm when the lens is in the deployed configuration.

18. The collapsible reflective optical sight of claim 14, wherein the upper portion of the lens is guided in a track in the hood when the lens is moved between the deployed and collapsed configurations; and the hood secures the lens in place with respect to the hood and the base in the deployed configuration.

19. The collapsible reflective optical sight of claim 14, wherein the upper portion of the lens rotates with respect to the hood;

a lower portion of the lens is guided in a track in the base when the lens is moved between the deployed and collapsed configurations, and the base secures the lens in place with respect to the hood and the base in the deployed configuration.

* * * * *